US011982173B2

(12) United States Patent
Clausen et al.

(10) Patent No.: US 11,982,173 B2
(45) Date of Patent: May 14, 2024

(54) AUTOMATED SYSTEMS AND METHODS FOR CONTROLLING THE OPERATION OF DOWNHOLE-ADJUSTABLE MOTORS

(71) Applicant: National Oilwell Varco, L.P., Houston, TX (US)

(72) Inventors: Jeffery Ronald Clausen, Tulsa, OK (US); Qunzhang Li, Austin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 17/735,033

(22) Filed: May 2, 2022

(65) Prior Publication Data

US 2023/0349283 A1 Nov. 2, 2023

(51) Int. Cl.
*E21B 44/06* (2006.01)
*E21B 21/08* (2006.01)

(52) U.S. Cl.
CPC ..... *E21B 44/06* (2013.01); *E21B 21/08* (2013.01)

(58) Field of Classification Search
CPC ... E21B 7/04; E21B 7/06; E21B 44/06; E21B 21/08
See application file for complete search history.

(56) References Cited

U.S. PATENT DOCUMENTS

2022/0010625 A1* 1/2022 Williams ..... E21B 4/02
2022/0403730 A1* 12/2022 Boone ..... E21B 44/00

* cited by examiner

*Primary Examiner* — Dany E Akakpo
(74) *Attorney, Agent, or Firm* — Conley Rose, P.C.

(57) ABSTRACT

A method for drilling a wellbore includes providing a mud motor connected to a downhole end of a drillstring, wherein a bend adjustment assembly of the mud motor is provided in a first configuration, pumping a drilling fluid at a drilling flowrate from a supply pump into the drillstring whereby a drill bit coupled to the drillstring is rotated to drill into the earthen formation, receiving by a drilling controller an actuation command instructing the drilling controller to shift the bend adjustment assembly from the first configuration to a second configuration, and operating by the drilling controller at least one of the supply pump to provide an actuation drilling fluid flowrate stored in a storage device of the drilling controller, and a rotary system to provide an actuation drillstring rotational speed stored in the storage device

21 Claims, 20 Drawing Sheets

AUTOMATED SYSTEMS AND METHODS FOR CONTROLLING THE OPERATION OF DOWNHOLE-ADJUSTABLE MOTORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

In drilling a wellbore into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a wellbore along a predetermined trajectory. In vertical drilling operations, the drillstring and drill bit are typically rotated from the surface with a top dive or rotary table. Drilling fluid or "mud" is typically pumped under pressure down the drillstring, out the face of the drill bit into the wellbore, and then up the annulus between the drillstring and the wellbore sidewall to the surface.

In some applications, horizontal and other non-vertical or deviated wellbores are drilled ("directional drilling") to facilitate greater exposure to and production from larger regions of subsurface hydrocarbon-bearing formations than would be possible using only vertical wellbores. In directional drilling, specialized drillstring components and "bottomhole assemblies" (BHAs) may be used to induce, monitor, and control deviations in the path of the drill bit, so as to produce a wellbore of the desired deviated configuration. Directional drilling may be carried out using a downhole or mud motor provided in the BHA. Downhole mud motors may include several components, such as, for example: (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling, the motor may include a bent housing to provide an angle of deflection between the drill bit and the BHA. In some instances, the deflection angle provided by the bent housing may be adjustable to allow the BHA to drill both curved and rectilinear sections of the wellbore.

BRIEF SUMMARY OF THE DISCLOSURE

An embodiment of a system for drilling a wellbore in a subterranean earthen formation comprises a drillstring, a supply pump configured to pump a drilling fluid into an uphole end of the drillstring, a rotary system coupled to the uphole end of the drillstring and configured to rotate the drillstring, a drill bit coupled to a downhole end of the drillstring and configured to drill into the earthen formation in response to rotation of the drillstring, a mud motor coupled to the downhole end of the drillstring, the mud motor comprising a driveshaft housing, a driveshaft assembly comprising a driveshaft housing and a driveshaft rotatably disposed in the driveshaft housing, a bearing assembly comprising a bearing housing and a bearing mandrel positioned in the bearing housing and coupled to the driveshaft, and a bend adjustment assembly shiftable between a first configuration that provides a first deflection angle between a longitudinal axis of the driveshaft housing and a longitudinal axis of the bearing mandrel, and a second configuration that provides a second deflection angle between the longitudinal axis of the driveshaft housing and the longitudinal axis of the bearing mandrel that is different from the first deflection angle, a drilling controller comprising a storage device storing an actuation drilling fluid flowrate, and an actuation drillstring rotational speed, and a drilling control module that is configured, in response to receiving an actuation command from a user, to operate at least one of the supply pump to provide the actuation drilling fluid flowrate, and the rotary system to provide the actuation drillstring rotational speed to thereby shift the bend adjustment assembly from the first configuration to the second configuration. In some embodiments, the drilling control module, in response to the actuation command, is configured to concurrently operate both the supply pump to provide the actuation drilling fluid flowrate and the rotary system to provide the actuation drillstring rotational speed. In some embodiments, the system comprises a bottom hole assembly (BHA) comprising the mud motor and a second tool in addition to the mud motor, and wherein the drilling controller is configured to control the operation of the second tool. In certain embodiments, the drilling control module is configured, in response to receiving the actuation command, to concurrently operate each of the supply pump, the rotary system, and a hoisting system of the system to displace the mud motor through the wellbore. In certain embodiments, the bend adjustment assembly comprises an actuator assembly comprising an actuator housing, an actuator ring positioned in the actuator housing and coupled to the bearing mandrel, and an actuator piston positioned in the actuator housing and coupled to the actuator housing, and the actuator assembly is configured to transfer torque between the bearing mandrel and the actuator housing in response to the provision of at least one of the actuation drilling fluid flowrate and the actuation drillstring rotational speed. In some embodiments, the bend adjustment assembly comprises an adjustment mandrel having a first axial position corresponding to the first configuration of the bend adjustment assembly and a second axial position that is axially spaced from the first axial position and which corresponds to the second configuration of the bend adjustment assembly, and the adjustment mandrel is configured to shift from the first axial position to the second axial position in response to the provision of the actuation drilling fluid flowrate. In certain embodiments, the bend adjustment assembly comprises an actuator assembly comprising an actuator housing, an actuator ring positioned in the actuator housing and coupled to the bearing mandrel, and an actuator piston positioned in the actuator housing and coupled to the actuator housing, the bend adjustment assembly comprises an offset housing coupled to the driveshaft housing whereby relative rotation between the offset housing and the driveshaft housing is restricted, and an adjustment mandrel coupled to the bearing housing whereby relative rotation between the adjustment mandrel and the bearing housing is restricted, and the actuator assembly is configured to rotate the adjustment mandrel relative to the offset housing in response to at least one of the provision of the actuation drilling fluid flowrate and the provision of the actuation drillstring rotational speed whereby the bend adjustment assembly is shifted from the first configuration to the second configuration. In certain embodiments, the bend adjustment assembly comprises a locked state which prevents the bend adjustment assembly from shifting between the first configuration and the second configuration, and an unlocked state in which the bend adjustment assembly is permitted to shift between the first configuration and the second configuration, the storage device stores an unlocking drilling fluid flowrate, and the drilling control module, in response to the actuation command, is configured to operate the supply pump to provide the unlocking drilling fluid flowrate to shift the bend adjustment assembly from the locked state to the unlocked state. In some embodiments, the bend adjustment assembly comprises a locking piston having a first axial position corresponding to the unlocked state and a second axial position that is spaced from the first axial position and corresponds to the locked state. In some embodiments, the storage device stores a locking drilling fluid flowrate, and the drilling control module, in response to receiving the actuation command, is configured to operate the supply pump to provide the locking drilling fluid flowrate to shift the bend adjustment assembly from the unlocked state to the locked state. In some embodiments, the drilling control module, in response to receiving the actuation command, is configured to provide an indication to the user of whether the bend adjustment assembly has successfully shifted into the second configuration. In certain embodiments, the storage device stores a drill-ahead drilling fluid flowrate and a drill-ahead drillstring rotation speed, and the drilling control module, in response to receiving a confirmation command from the user confirming the bend adjustment assembly is in the second configuration, is configured to operate the supply pump to provide the drill-ahead drilling fluid flowrate, and to operate the rotary system to provide the drill-ahead drillstring rotational speed. In certain embodiments, the storage device stores a drill-ahead rate of penetration (ROP), and the drilling control module, in response to receiving the confirmation command from the user confirming the bend adjustment assembly is in the second configuration, is configured to operate a hoisting system of the system to provide the mud motor with the drill-ahead ROP.

An embodiment of a method for drilling a wellbore in a subterranean earthen formation comprises (a) providing a mud motor connected to a downhole end of a drillstring in a wellbore extending through the earthen formation, wherein a bend adjustment assembly of the mud motor is provided in a first configuration providing a first deflection angle along the mud motor, (b) pumping a drilling fluid at a drilling flowrate from a supply pump into the drillstring whereby a drill bit coupled to the downhole end of the drillstring is rotated to drill into the earthen formation, (c) receiving by a drilling controller an actuation command from a user instructing the drilling controller to shift the bend adjustment assembly from the first configuration to a second configuration providing a second deflection angle along the mud motor that is different from the first configuration, and (d) operating by the drilling controller at least one of the supply pump to provide an actuation drilling fluid flowrate stored in a storage device of the drilling controller, and a rotary system to provide an actuation drillstring rotational speed stored in the storage device whereby the bend adjustment assembly is shifted by the drilling controller from the first configuration to the second configuration. In some embodiments, (d) comprises concurrently operating by the drilling controller both the supply pump to provide both the actuation drilling fluid flowrate and the rotary system to provide the actuation drillstring rotational speed. In some embodiments, (d) comprises simultaneously operating by the drilling controller the supply pump to provide the actuation drilling flowrate, the rotary system to provide the actuation drillstring rotational speed, and a hoisting system connected to the drillstring to provide either an actuation off-bottom distance between the drill bit and a bottom of the wellbore or an actuation rate of penetration (ROP) of the drill bit through the wellbore. In some embodiments, (d) comprises transferring torque between a bearing mandrel of the mud motor and an actuator housing of an actuator assembly of the bend adjustment assembly that is coupled to a bearing housing of the mud motor whereby relative rotation between the bearing housing and the actuator housing is restricted. In certain embodiments, (d) comprises shifting an adjustment mandrel of the bend adjustment assembly from a first axial position associated with the first configuration of the bend adjustment assembly to a second axial position that is spaced from the first axial position and associated with the second configuration. In some embodiments, the method comprises (e) operating by the drilling controller the supply pump to provide a locking drilling fluid flowrate stored in the storage device to thereby shift the bend adjustment assembly from an unlocked state to a locked state preventing the bend adjustment assembly from shifting between the first configuration and the second configuration. In some embodiments, the method comprises (f) operating by the drilling controller the supply pump to provide an unlocking drilling fluid flowrate stored in the storage device to thereby shift the bend adjustment assembly from the locked state to the unlocked state to permit the bend adjustment assembly to shift between the first configuration and the second configuration. In certain embodiments, the method comprises (e) indicating by the drilling controller to the user a differential between a baseline inlet drilling fluid pressure stored in the storage device and a current inlet drilling fluid pressure, and (f) operating by the drilling controller both the supply pump to provide a drill-ahead drilling fluid flowrate stored in the storage device, and the rotary system to provide a drill-ahead drillstring rotational speed in response to receiving a confirmation command from the user confirming the bend adjustment assembly is in the second configuration. In certain embodiments, the method comprises (e) operating by the drilling controller a hoisting system connected to the drillstring to position the drill bit at a desired distance from the bottom of the wellbore prior to (d). In some embodiments, (d) comprises operating by the drilling controller the hoisting system to displace the bend adjustment assembly longitudinally through the wellbore as the bend adjustment assembly is shifted from the first configuration to the second configuration.

An embodiment of a drilling controller for controlling the operation of a drilling system having a downhole-adjustable mud motor comprises a storage device storing an actuation drilling fluid flowrate providable by a supply pump of the drilling system, and an actuation drillstring rotational speed providable by a rotary system of the drilling system, and a drilling control module that is configured, in response to receiving an actuation command from a user and when the drilling control module is connected to at least one of the supply pump and the rotary system, to operate at least one of the supply pump to provide the actuation drilling fluid flowrate and the rotary system to provide the actuation drilling fluid flowrate and the actuation drillstring rotational speed to shift a bend adjustment assembly of the mud motor from a first configuration providing a first deflection angle along the mud motor to a second configuration providing a second deflection angle along the mud motor that is different from the first deflection angle. In some embodiments, the drilling control module is configured, in response to the actuation command and when the drilling control module is connected to both the supply pump and the rotary system, to concurrently operate both the supply pump to provide the actuation drilling fluid flowrate and the rotary system to provide the actuation drillstring rotational speed. In some embodiments, the drilling control module is configured, in response to the actuation command and when the drilling control module is connected to the supply pump, the rotary system, and a hoisting system, to concurrently operate the supply pump to provide the actuation drilling fluid flowrate, the rotary system to provide the actuation drillstring rotational speed, and the hoisting system to provide either an actuation off-bottom distance between a drill bit connected to the mud motor and a bottom of a wellbore or an actuation rate of penetration (ROP) of the drill bit through the wellbore. In certain embodiments, the drilling control module is configured, in response to the actuation command and when connected to the supply pump, to operate the supply pump to provide a locking drilling fluid flowrate stored in the storage device to shift the bend adjustment assembly from an unlocked state to a locked state to prevent the bend adjustment assembly to shift between the first configuration and the second configuration. In certain embodiments, the drilling control module is configured, in response to the actuation command and when connected to the supply pump, to operate the supply pump to provide an unlocking drilling fluid flowrate stored in the storage device to shift the bend adjustment assembly from the locked state to the unlocked state to permit the bend adjustment assembly to shift between the first configuration and the second configuration. In some embodiments, the drilling control module, in response to receiving the actuation command, is configured to provide an indication to the user of whether the bend adjustment assembly has successfully shifted into the second configuration. In some embodiments, the storage device stores a drill-ahead drilling fluid flowrate and a drill-ahead drillstring rotation speed, and the drilling control module, when connected to both the supply pump and the rotary system and in response to receiving a confirmation command from the user confirming the bend adjustment assembly is in the second configuration, is configured to operate the supply pump to provide the drill-ahead drilling fluid flowrate, and to operate the rotary system to provide the drill-ahead drillstring rotational speed. In certain embodiments, the storage device stores a drill-ahead rate of penetration (ROP), and the drilling control module, when connected to the supply pump, the rotary system, and a hoisting system of the drilling system and in response to receiving a confirmation command from the user confirming the bend adjustment assembly is in the second configuration, is configured to operate the hoisting system to provide the mud motor with the drill-ahead ROP.

BRIEF DESCRIPTION OF THE DRAWINGS

For a detailed description of disclosed embodiments, reference will now be made to the accompanying drawings in which.

DETAILED DESCRIPTION

Figure 1:
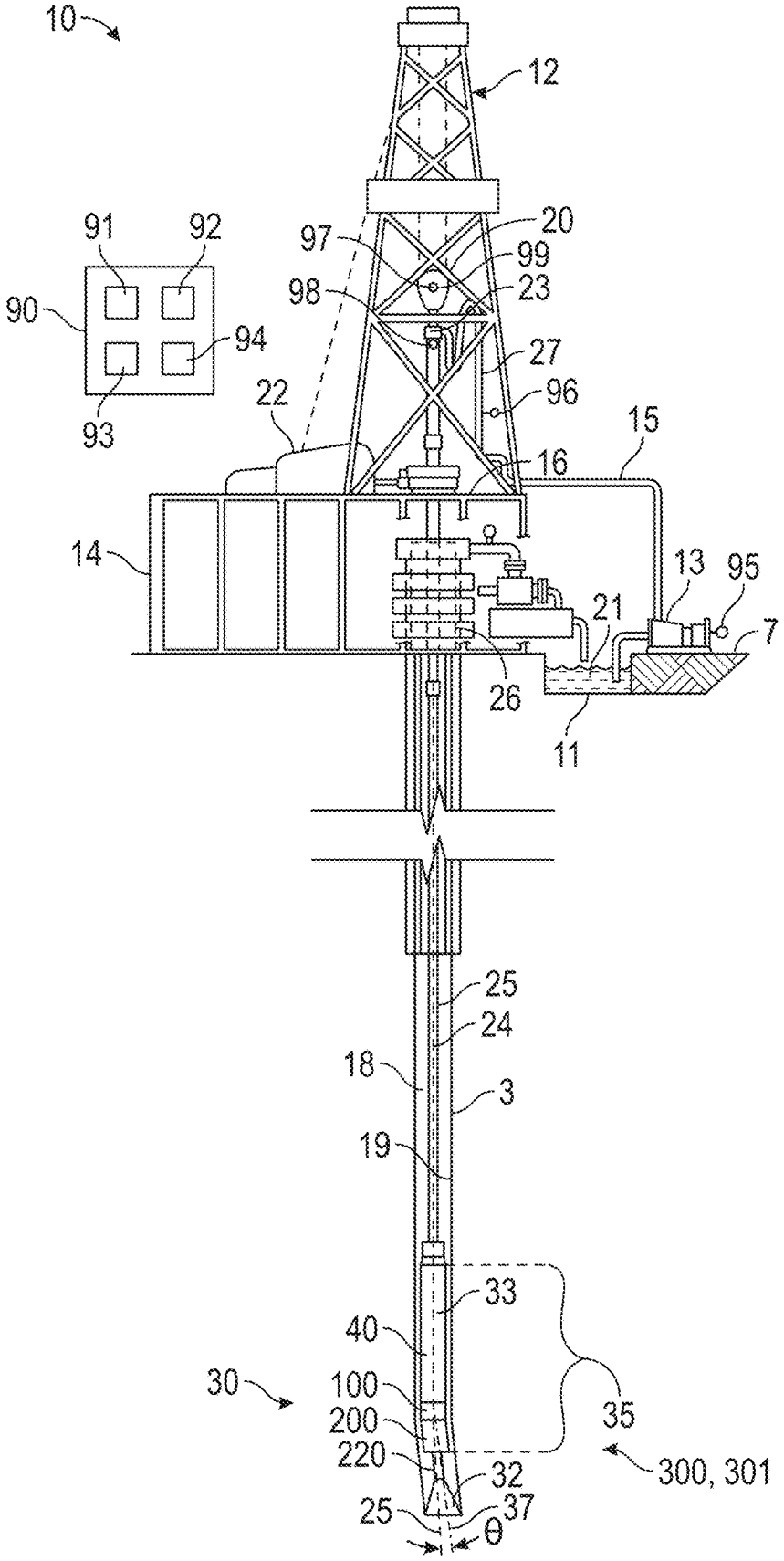
FIG. 1 is a schematic view of an embodiment of a drilling system including a downhole mud motor.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (for example, central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As previously described, some downhole mud motors used for drilling subterranean wellbores include a bent housing for forming a non-zero angle along the mud motor to thereby permit the motor to drill directionally through an earthen formation. Some of these bent housings may comprise an adjustable bent housing or bend assembly having a plurality of configurations providing a corresponding plurality of different deflection angles along a mud motor comprising the adjustable bend assembly. In some instances, the bend adjustment assembly is adjusted manually at the surface by a drilling operator. In other instances, the bend adjustment assembly may be shifted in-situ within the wellbore between the different configurations providable by the bend adjustment assembly.

In some applications, a drilling operator may manually alter several different drilling parameters such as a drilling fluid flowrate and a drillstring rotational speed to thereby shift the bend adjustment assembly from a first configuration to a second configuration in-situ within the wellbore. The drilling operator may need to monitor several different displays and manually calculate certain drilling parameters based on the information available to the drilling operator during this process in order to execute or provide the drilling parameters required to shift the bend adjustment assembly from a first configuration to a second configuration. For example, the drilling parameter may need to manually determine what kind and magnitude of input must be provided to a supply pump in order to provide a desired drilling fluid flowrate to the bend adjustment assembly. The drilling operator may also be required to monitor other drilling parameters while operating equipment of the drilling system to achieve the desired drilling parameters for shifting the bend adjustment assembly. For example, the drilling operator may be required to monitor and alter downhole pressure or other parameters very rapidly in order to avoid an undesirable overpressurization as the operator adjusts the operation of the supply pump to provide the desired drilling fluid flowrate. Failure to monitor and react quickly can cause an unsafe situation on the drilling rig to occur.

The need to monitor simultaneously multiple drilling parameters and the need to manually determine by the drilling operator on-the-fly certain parameters required to achieve the desired shifting of the bend adjustment assembly invites manual error and miscalculations which may prevent the operator from successfully shifting the bend adjustment assembly. Manual error such as data mis-entry (inputting the wrong values) may also lead to the stalling of the mud motor or worse such as an overpressurization of drilling equipment that may jeopardize the integrity of the drilling equipment and the safety of the drilling operator. In order to mitigate these risks, process of shifting the bend adjustment assembly must be broken down into separate, sequentially performed steps to reduce the requirements placed on the drilling operator at any given time. However, this sequentialization of the process for shifting the bend adjustment assembly increases the time required for shifting the bend adjustment assembly, and thus undesirably increases the time required for performing a drilling operation using the bend adjustment assembly. Moreover, the risks of manual error briefly outlined above are still present even when the process of shifting the bend adjustment assembly is broken down into separate sequential steps.

Accordingly, embodiments of drilling controllers are described herein for automatically shifting bend adjustment assemblies of downhole mud motors in-situ within a wellbore. For example, upon receiving an input command from a drilling operator or other user, the drilling controller may automatically operate various drilling equipment (for example, a supply pump, a rotary system, a hoisting system of a drilling system) to achieve the drilling parameters required to shift a bend adjustment assembly in-situ between a plurality of separate configurations providing a corresponding plurality of separate deflection angles along a mud motor comprising the bend adjustment assembly.

The drilling controller may automatically determine how to operate the various drilling equipment based on information communicated to the drilling controller by a plurality of sensors connected to the drilling controller, removing the possibility of manual error in operating the drilling equipment to achieve the desired shifting of the bend adjustment assembly. The drilling controller may also perform multiple actions simultaneously to thereby reduce the time required for shifting the bend adjustment assembly while ensuring the safety of the drilling operator and protecting the integrity of the drilling equipment. As an example, the drilling controller may concurrently operate a supply pump to provide a desired drilling fluid flowrate, a rotary system to provide a desired drillstring rotational speed, and potentially a hoisting system to provide either a correct off-bottom distance from a bottom or terminal end of the borehole or a correct rate of penetration (ROP) to aid in shifting the bend adjustment assembly and to minimize the time required for shifting the bend adjustment assembly. Additionally, the drilling controller may automatically monitor various drilling parameters as the drilling controller operates various equipment of the drilling system to ensure that undesirable phenomena such as the stalling of the mud motor and the overpressurization of various drilling equipment is avoided.

Referring to FIG. 1, an embodiment of a well or drilling system 10 is shown. In this exemplary embodiment, drilling system 10 generally includes a vertical support structure or derrick 12 supported by a drilling platform or rig 14. Platform 14 includes a drill deck or rig floor 16. Derrick 12 includes a traveling block 20 controlled by a hoisting system or drawworks 22 for raising and lowering a rotary system or top drive 23 suspended from the travelling block 20. Top drive 23 is connected to a drillstring 24 which extends along a central or longitudinal axis 25 into a wellbore 3. Top drive 23 includes one or more motors for rotating an uphole end of the drillstring 24 at the surface 7. Drillstring 24 of drilling system 10 extends downward through a blowout preventer (BOP) stack 26, and into a wellbore 3 that extends into a subterranean earthen formation 5 from the surface 7. Drillstring 24 is formed from a plurality of drill pipe joints connected end-to-end. In this exemplary embodiment, a bottom-hole-assembly (BHA) 30 is attached to the lowermost pipe joint of drillstring 24, and a drill bit 32 is attached to the downhole end of BHA 30.

Drilling system 10 further includes a drilling fluid reservoir or mud tank 11, a surface supply pump 13, a supply line 15 connected to the outlet of supply pump 13, and a standpipe 27 for supplying drilling fluid 21 to the drillstring 24. A downhole mud motor 35 is provided in BHA 30 for facilitating the drilling of deviated portions of wellbore 3. Moving downward along BHA 30, motor 35 includes a hydraulic drive or power section 40, a driveshaft assembly 100, and a bearing assembly 200. In some embodiments, the portion of BHA 30 disposed between drillstring 24 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 24 into rotational torque for driving the rotation of drill bit 32. Driveshaft assembly 100 and bearing assembly 200 transfer the torque generated in power section 40 to bit 32. With force or weight applied to the drill bit 32 by the drillstring 24 and BHA 30, also referred to as weight-on-bit ("WOB"), the rotating drill bit 32 engages the earthen formation and proceeds to form wellbore 3 along a predetermined path toward a target zone. The drilling fluid 21 pumped down the drillstring 24 and through BHA 30 from supply pump 13 passes out of the face of drill bit 32 and back up an annulus 18 formed between drillstring 24 and a wall 19 of wellbore 3. The drilling fluid 21 cools the bit 32, and flushes the cuttings away from the face of bit 32 and carries the cuttings to the surface.

In this exemplary embodiment, drilling system 10 includes a drilling control system or controller 90 that may selectably control the operation of certain components of drilling system 10. The drilling controller 90 includes a processor 91 (which may be referred to as a central processor unit or CPU) that is in communication with one or more memory devices 92, input/output (I/O) devices 93, and one or more communication devices 94. In some embodiments, the entire drilling controller 90 may be supported on the platform 14; however, in other embodiments, at least some of the components of drilling controller 90 may not be located on the platform 14 and instead may be remotely located and in communication with other components of drilling controller 90 via a network such as the Internet.

The processor 91 may be implemented as one or more CPU chips. The memory devices 92 of drilling controller 90 may include secondary storage (for example, one or more disk drives), a non-volatile memory device such as read only memory (ROM), and a volatile memory device such as random-access memory (RAM). In some contexts, the secondary storage ROM, and/or RAM comprising the memory devices 92 of drilling controller 90 may be referred to as a non-transitory computer readable medium or a computer readable storage media. I/O devices 93 may include printers, video monitors, liquid crystal displays (LCDs), touch screen displays, keyboards, keypads, switches, dials, mice, and/or other well-known input devices.

The communication devices 94 of drilling controller 90 may include one or more wired and wireless communication devices in signal communication with components of drilling system 10. For example, the communication devices 94 of drilling controller 90 may communicate with a pump sensor 95 of supply pump 13, an inlet pressure sensor 96 positioned along the standpipe 27, a hookload sensor 97 coupled to the drawworks 22 and configured to determine WOB applied to the drill bit 32, a rotation sensor 98 coupled to top drive 23 and configured to determine the amount of torque applied to the drillstring 24 and a rotational speed of the drillstring 24, and a block position sensor 99 for measuring a vertical position or speed of the travelling block 20. Block position sensor 99 may determine an off-bottom position or distance between drill bit 32 and the bottom of the wellbore 3, or the ROP of BHA 30 through the wellbore 3. It may be understood that drilling controller 90 may be connected to additional sensors of drilling system 10 through the communication devices 94. Additionally, drilling controller 90 may control one or more components of drilling system 10 through the communication devices 94. For example, drilling controller 90 may control the operation of supply pump 13, drawworks 22, and top drive 23 through communication devices 94.

It is understood that by programming and/or loading executable instructions onto the drilling controller 90, at least one of the processor 91, the memory devices 92 are changed, transforming the drilling controller 90 in part into a particular machine or apparatus having the novel functionality taught by the present disclosure. As will be discussed further herein, after the drilling controller 90 is turned on or booted, the processor 91 may execute a computer program or application. For example, the processor 91 may execute software or firmware stored in the memory devices 92. During execution, an application may load instructions into the processor 91, for example load some of the instructions of the application into a cache of the processor 91. In some contexts, an application that is executed may be said to configure the processor 91 to do something, for example, to configure the processor 91 to perform the function or functions promoted by the subject application. When the processor 91 is configured in this way by the application, the processor 91 becomes a specific purpose computer or a specific purpose machine.

In some embodiments, drilling controller 90 may control the operation of downhole tools in addition to motor 35. For example, drilling controller 90 may control both motor 35 and a second tool 33 of BHA 30. In some embodiments, the second tool 33 may comprise, for example, a hydraulic or mechanical drilling or fishing jar, a circulation sub or valve, an agitator or downhole friction reduction system (e.g., flow activated or activatable via a ball drop), an underreamer or expandable reamer, downhole mechanical or hydraulic thrusters, downhole slip clutch tools having multiple drilling modes, etc. Drilling controller 90 may control the operation of second tool 33 through the operation of one or more of supply pump 13, drawworks 22, and top drive 23. For example, in an embodiment in which second tool 33 comprises a circulation sub, drilling controller 90 may control the operation of supply pump 13 to provide an actuation fluid flowrate sufficient to shift the circulation sub between open and closed configurations. In certain embodiments, drilling controller 90 may control both motor 35 and second tool 33 simultaneously.

Figure 2:
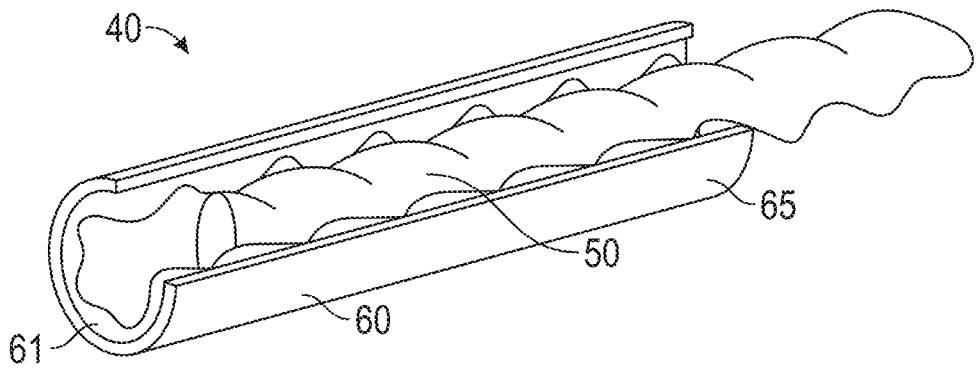
FIG. 2 is a perspective, partial cut-away view of the mud motor of FIG. 1.
Figure 3:
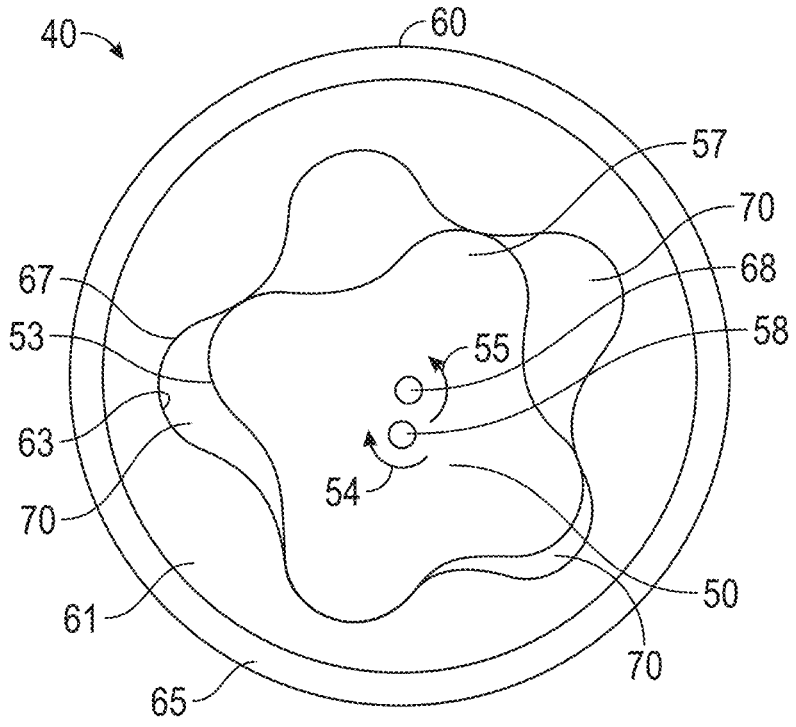
FIG. 3 is a cross-sectional end view of the mud motor of FIG. 1.
Figure 4:
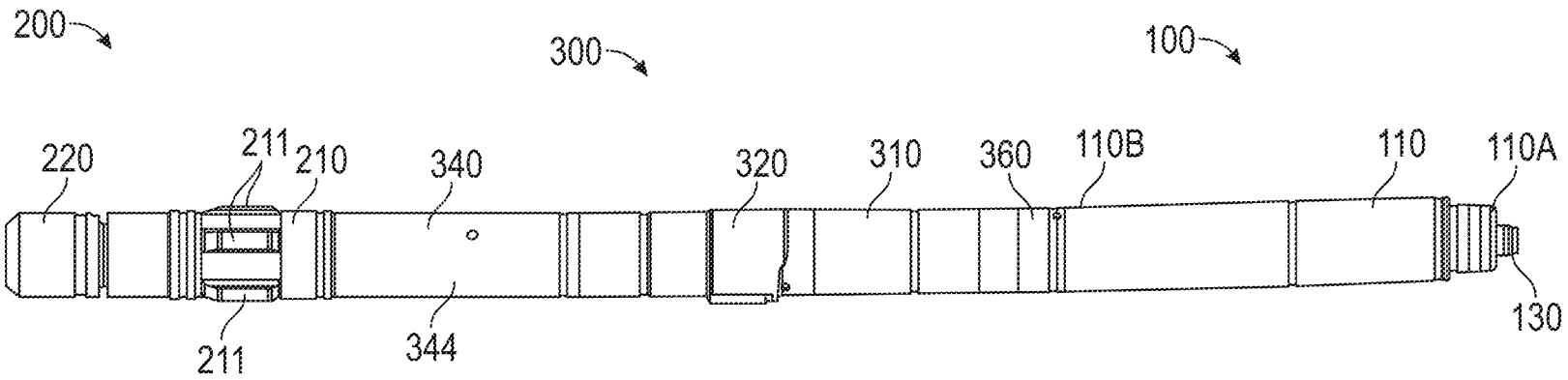
FIG. 4 is a side view of the mud motor of FIG. 1, FIG. 4 illustrating a driveshaft assembly, a bearing assembly, and a bend adjustment assembly of the mud motor of FIG. 1 disposed in a first position.
Figure 5:
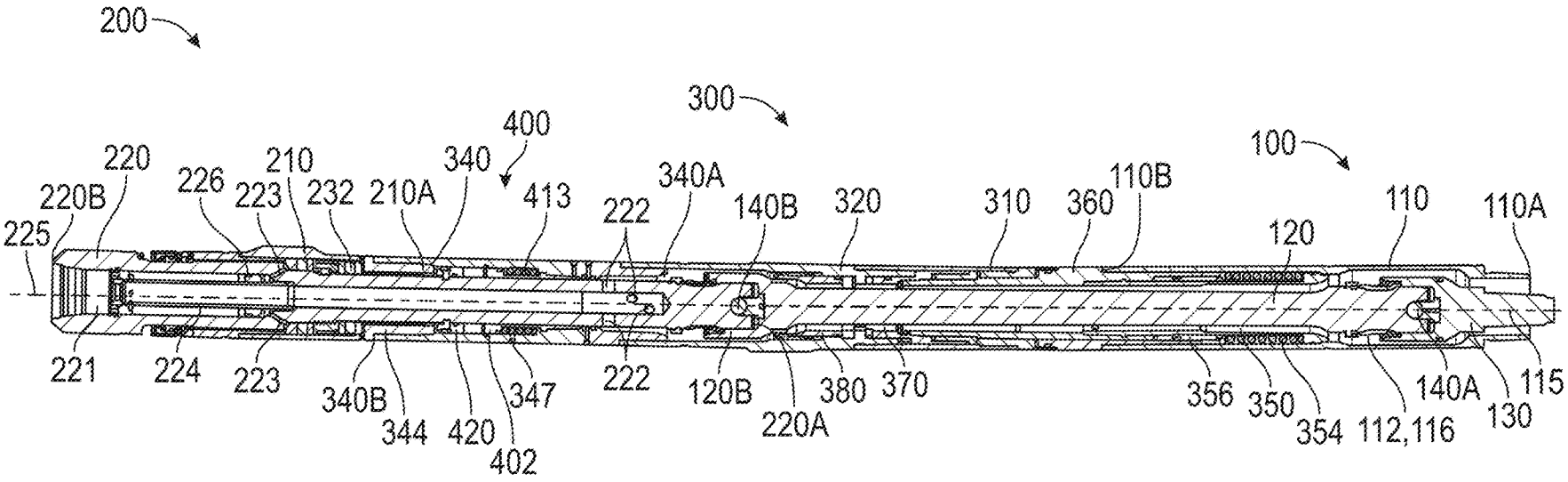
FIG. 5 is a side cross-sectional view of the mud motor of FIG. 4.
Figure 6:
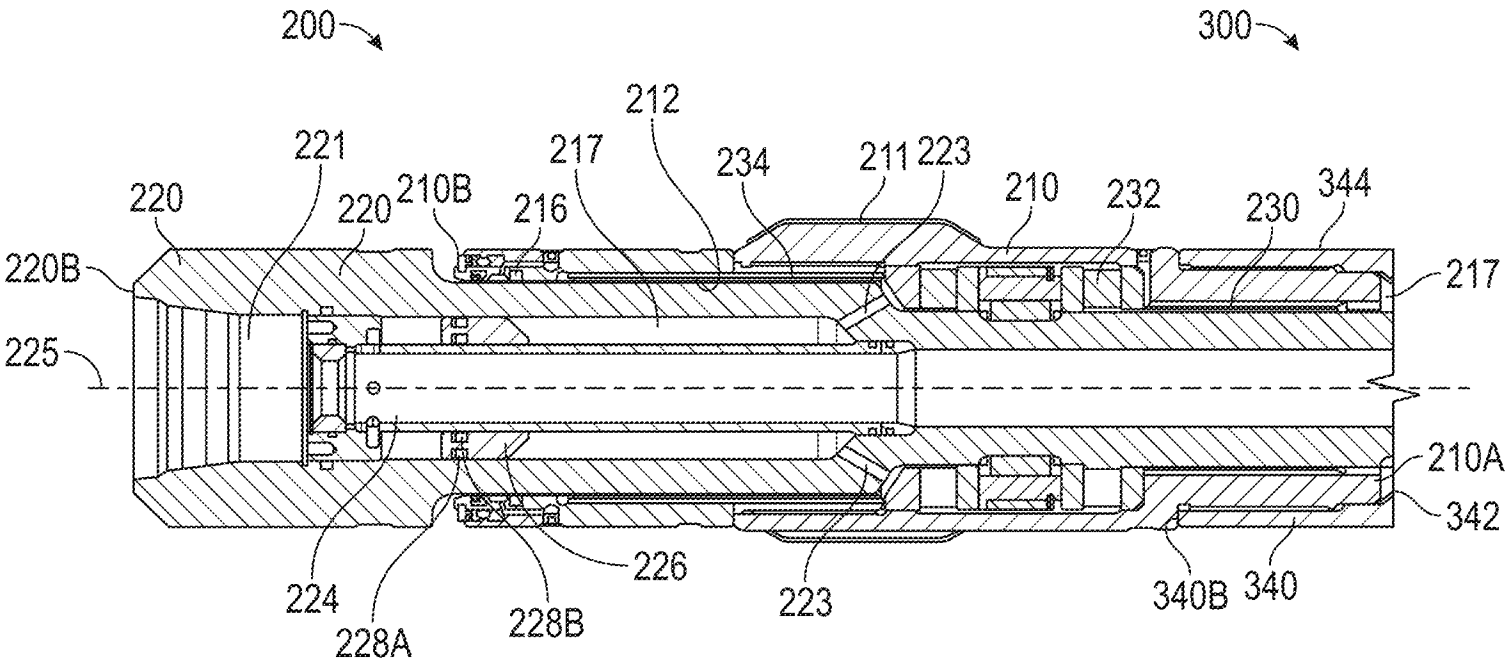
FIGS. 6-8 are zoomed-in, side cross-sectional views of the mud motor of FIG. 1.
Figure 7:
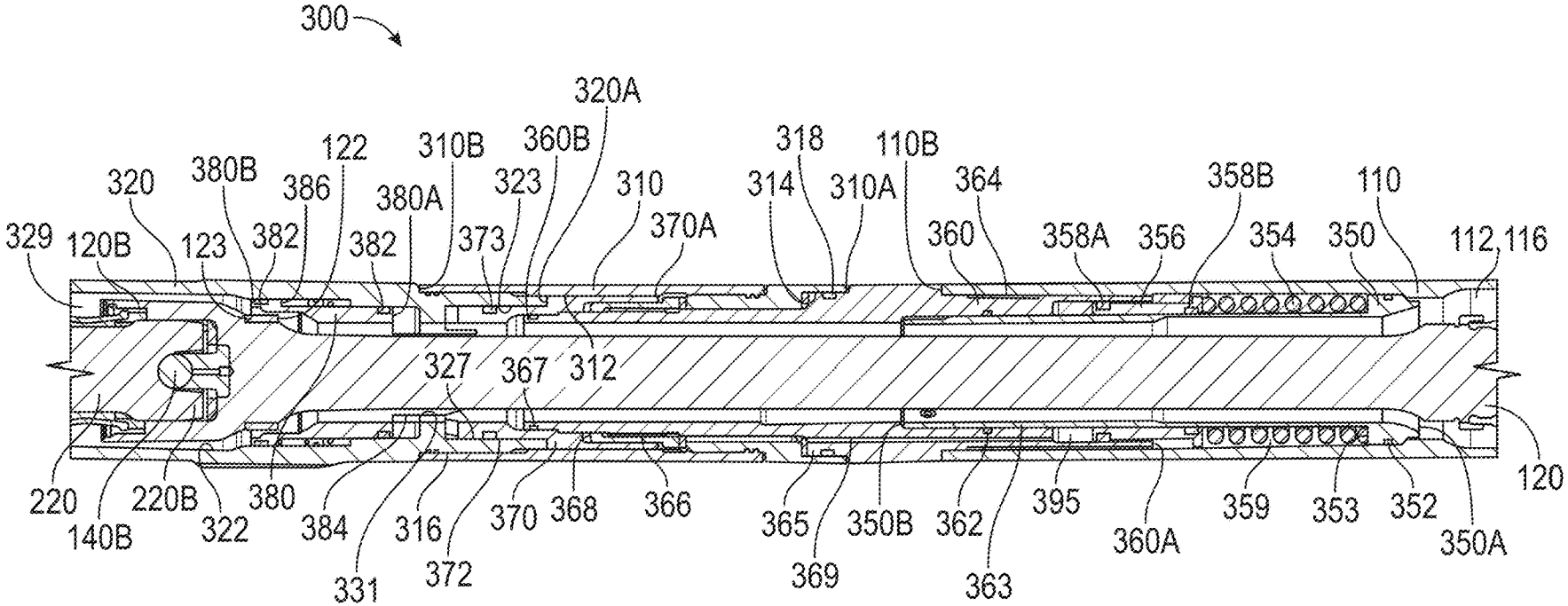

Referring to FIGS. 2 and 3, an embodiment of the power section 40 of BHA 30 is shown. In this exemplary embodiment, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are defined between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the power section 40, fluid is pumped under pressure into one end of the power section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of power section 40 and continues to drive the rotation of the rotor 50. Driveshaft assembly 100 (shown in FIG. 1) includes a driveshaft discussed in more detail below that has an uphole end coupled to the downhole end of rotor 50. In this arrangement, the rotational motion and torque of rotor 50 is transferred to drill bit 32 via driveshaft assembly 100 and bearing assembly 200.

Referring again to FIG. 1, the driveshaft assembly 100 of mud motor 35 is coupled to bearing assembly 200 via a bend adjustment assembly 300 of motor 35 that provides an adjustable bend 301 along motor 35. Bend 301 forms a deflection angle θ between a central or longitudinal axis 37 of drill bit 32 and the longitudinal axis 25 of drillstring 24.

As will be discussed further herein, drillstring 24 may be rotated from platform 14 by top drive 23 to rotate BHA 30 and the drill bit 32 coupled thereto to drill a straight section of wellbore 3. Drillstring 24 and BHA 30 rotate about the central axis 25 of drillstring 24, and thus, drill bit 32 is also forced to rotate about the longitudinal axis of drillstring 24. With bit 32 disposed at deflection angle θ, the downhole end of drill bit 32 distal BHA 30 seeks to move in an arc about longitudinal axis 25 of drillstring 24 as it rotates, but is restricted by the sidewall 19 of wellbore 3, thereby imposing bending moments and associated stress on BHA 30 and mud motor 35. As will be discussed further herein, the magnitude of the deflection angle θ may be adjusted when BHA 30 is positioned in the wellbore 3. For example, the magnitude of the deflection angle θ may be adjusted by drilling controller 90 in response to a user input received by the drilling controller 90 through the I/O devices 93.

In general, driveshaft assembly 100 functions to transfer torque from the eccentrically-rotating rotor 50 of power section 40 to a concentrically-rotating bearing mandrel 220 (shown in FIG. 1) of bearing assembly 200 and drill bit 32. As best shown in FIG. 3, rotor 50 rotates about rotor axis 58 in the direction of arrow 54, and rotor axis 58 rotates about stator axis 68 in the direction of arrow 55. However, drill bit 32 and bearing mandrel 220 are coaxially aligned and rotate about a common axis that is offset and/or oriented at an acute angle relative to rotor axis 58. Thus, driveshaft assembly 100 converts the eccentric rotation of rotor 50 to the concentric rotation of bearing mandrel 220 and drill bit 32, which are radially offset and/or angularly skewed relative to rotor axis 58.

Referring now to FIGS. 4-7, embodiments of driveshaft assembly 100, bearing assembly 200, and bend adjustment assembly 300 are shown. In this exemplary embodiment, driveshaft assembly 100 includes an outer driveshaft housing 110 and a one-piece (unitary) driveshaft 120 rotatably disposed within housing 110. Housing 110 has a linear central or longitudinal axis 115, a first or uphole end 110A, a second or downhole end 110B opposite uphole end 110A and coupled to an outer bearing housing 210 of bearing assembly 200 via the bend adjustment assembly 300. Driveshaft housing 110 also includes a central bore or passage 112 extending between ends 110A and 110B. In an embodiment, an externally threaded connector or pin end of driveshaft housing 110 is located at uphole end 110A which threadably engages a mating internally threaded connector or box end comprising the downhole end of stator housing 65. Additionally, an internally threaded connector or box end of driveshaft housing 110 may be located at downhole end 1106 and threadably engage a mating externally threaded connector of bend adjustment assembly 300.

Driveshaft 120 of driveshaft assembly 100 has a linear central or longitudinal axis, a first or uphole end 120A, and a second or downhole end 120B opposite end 120A. Uphole end 120A is pivotally coupled to the downhole end of rotor 50 (not shown in FIGS. 4-7) via a driveshaft adapter 130 and a first or uphole universal joint 140A. Additionally, a downhole end 120B of driveshaft 120 is pivotally coupled to an uphole end 220A of bearing mandrel 220 with a second or downhole universal joint 140B. In this exemplary embodiment, uphole end 120A of driveshaft 120 and uphole universal joint 140A are disposed within driveshaft adapter 130, whereas downhole end 120B of driveshaft 120 comprises an axially extending counterbore or receptacle that receives uphole end 220A of bearing mandrel 220 and downhole universal joint 140B. In this exemplary embodiment, the outer surface of driveshaft 120 includes an annular shoulder 122 that receives an annular flow restrictor 123 thereon.

Driveshaft adapter 130 of driveshaft assembly 100 extends along a central or longitudinal axis between a first or uphole end coupled to rotor 50, and a second or downhole end coupled to the uphole end 120A of driveshaft 120. In this exemplary embodiment, the uphole end of driveshaft adapter 130 comprises an externally threaded male pin or pin end that threadably engages a mating female box or box end at the downhole end of rotor 50. A receptacle or counterbore extends axially from the downhole end of adapter 130. The uphole end 120A of driveshaft 120 is disposed within the counterbore of driveshaft adapter 130 and pivotally couples to adapter 130 via the uphole universal joint 140A disposed within the counterbore of driveshaft adapter 130. Since rotor axis 58 is radially offset and/or oriented at an acute angle relative to a central or longitudinal axis 225 of bearing mandrel 220, the central axis of driveshaft 120 may be skewed or oriented at an acute angle relative to axis 115 of housing 110, axis 58 of rotor 50, and a central axis 225 of bearing mandrel 220. However, universal joints 140A and 140B accommodate for the angularly skewed driveshaft 120, while simultaneously permitting rotation of the driveshaft 120 within driveshaft housing 110.

In general, each universal joint (for example, each universal joint 140A and 140B) may comprise any joint or coupling that allows limited freedom of movement in any direction while transmitting rotary motion and torque. For example, universal joints 140A, 140B may comprise universal joints (Cardan joints, Hardy-Spicer joints, Hooke joints), constant velocity joints, or any other custom designed joint. In other embodiments, driveshaft assembly 100 may include a flexible shaft comprising a flexible material (for example, Titanium) that is directly coupled (for example, threadably coupled) to rotor 50 of power section 40 in lieu of driveshaft 120, where physical deflection of the flexible shaft (the flexible shaft may have a greater length relative driveshaft 120) accommodates axial misalignment between driveshaft assembly 100 and bearing assembly 200 while allowing for the transfer of torque therebetween.

As previously described, adapter 130 couples driveshaft 120 to the downhole end of rotor 50. During drilling operations, high pressure drilling fluid is pumped under pressure from supply pump 13 down drillstring 24 and through cavities 70 between rotor 50 and stator 60, causing rotor 50 to rotate relative to stator 60. Rotation of rotor 50 drives the rotation of driveshaft adapter 130, driveshaft 120, bearing assembly mandrel 220, and drill bit 32. The drilling fluid flowing down drillstring 24 through power section 40 also flows through driveshaft assembly 100 and bearing assembly 200 to drill bit 32, where the drilling fluid flows through nozzles in the face of bit 32 into annulus 18. Within driveshaft assembly 100 and the uphole portion of bearing assembly 200, the drilling fluid flows through an annulus 116 formed between driveshaft housing 110 and driveshaft 120.

Referring still to FIGS. 4-7, bearing housing 210 of bearing assembly 200 has a linear central or longitudinal axis disposed coaxial with central axis 225 of mandrel 220, a first or uphole end 210A coupled to downhole end 110B of driveshaft housing 110 via bend adjustment assembly 300, a second or downhole end 210B opposite uphole end 210A, and a central through bore or passage extending axially between ends 210A and 210B. In some embodiments, the uphole end 210A comprises an externally threaded connector or pin end coupled with bend adjustment assembly 300. Bearing housing 210 may be coaxially aligned with bit 32, however, due to bend 301 between driveshaft assembly 100 and bearing assembly 200, bearing housing 210 may at times be oriented at a non-zero angle relative to driveshaft housing 110. Bearing housing 210 may include a plurality of circumferentially spaced stabilizers 211 extending radially outwards therefrom and configured to stabilize or centralize the position of bearing housing 210 in wellbore 3.

Bearing mandrel 220 of bearing assembly 200 has a first or uphole end 220A, a second or downhole end 220B opposite uphole end 220A, and a central through passage 221 extending axially from downhole end 220B and terminating at a location spaced from both ends 220A, 220B. The uphole end 220A of bearing mandrel 220 may be directly coupled to the downhole end 120B of driveshaft 120 via downhole universal joint 140B. Additionally, the downhole end 220B of mandrel 220 is coupled to drill bit 32. In this exemplary embodiment, bearing mandrel 220 includes one or more drilling fluid ports 222 extending radially from passage 221 to the outer surface of mandrel 220, and one or more lubrication ports 223 also extending radially from passage 221 to the outer surface of mandrel 220. Drilling fluid ports 222 are disposed proximal an uphole end of passage 221 and lubrication ports 223 are disposed downhole from ports 222. In this arrangement, lubrication ports 223 are separated or sealed from passage 221 of bearing mandrel 220 and the drilling fluid flowing through passage 221. Drilling fluid ports 222 provide fluid communication between annulus 116 and passage 221. During drilling operations, high pressure drilling fluid is pumped through power section 40 to drive the rotation of rotor 50, which in turn drives the rotation of driveshaft 120, mandrel 220, and drill bit 32. The drilling fluid flowing through power section 40 flows through annulus 116, drilling fluid ports 222 and passage 221 of mandrel 220 in route to drill bit 32.

In this exemplary embodiment, bearing housing 210 has a central bore or passage defined by a radially inner surface 212 that extends between ends 210A and 210B. An annular downhole seal 216 is disposed in the inner surface 212 proximal downhole end 210B. Additionally, an uphole annular seal may be positioned radially between bearing mandrel 220 and an actuator housing 340 of bend adjustment assembly 300 sealingly engages the outer surface of bearing mandrel 220 to define an annular oil or lubricant filled chamber 217 formed radially between the housings 210, 340 and bearing mandrel 220 and extending axially between downhole seal 216 and the uphole seal.

Additionally, in this exemplary embodiment, bearing mandrel 220 includes a central sleeve 224 disposed in passage 221 and coupled to an inner surface of mandrel 220 defining passage 221. An annular piston 226 is slidably disposed in passage 221 radially between the inner surface of mandrel 220 and an outer surface of sleeve 224, where piston 226 includes a first or outer annular seal 228A that seals against the inner surface of mandrel 220 and a second or inner annular seal 228B that seals against the outer surface of sleeve 224. In this arrangement, chamber 217 extends into the annular space (via lubrication ports 223) formed between the inner surface of mandrel 220 and the outer surface of sleeve 224 that is sealed from the flow of drilling fluid through passage 221 via the annular seals 228A and 228B of piston 226.

In this exemplary embodiment, a first or uphole radial bearing 230, a thrust bearing assembly 232, and a second or downhole radial bearing 234 are each disposed in chamber 217 and about the bearing mandrel 220. In general, radial bearings 230, 234 permit rotation of mandrel 220 relative to housing 210 while simultaneously supporting radial forces therebetween. Annular thrust bearing assembly 232 permits rotation of mandrel 220 relative to housing 210 while simultaneously supporting axial loads in both directions (for example, off-bottom and on-bottom axial loads). In this exemplary embodiment, radial bearings 230, 234 and thrust bearing assembly 232 are oil-sealed bearings. Particularly, chamber 217 comprises an oil or lubricant filled chamber that is pressure compensated via piston 226. In this configuration, piston 226 equalizes the fluid pressure within chamber 217 with the pressure of drilling fluid flowing through passage 221 of mandrel 220 towards drill bit 32. As previously described, in this exemplary embodiment, bearings 230, 232, 234 are oil-sealed. However, in other embodiments, the bearings of the bearing assembly (for example, bearing assembly 200) are mud lubricated and may comprise hard-faced metal bearings or diamond bearings.

Referring to FIGS. 5-12, bend adjustment assembly 300 couples driveshaft housing 110 to bearing housing 210, and (at times) introduces bend 301 and deflection angle θ along motor 35. Central axis 115 of driveshaft housing 110 is coaxially aligned with axis 25 of drillstring 24, and central axis 225 of bearing mandrel 220 is coaxially aligned with axis 37 of drill bit 32, thus, deflection angle θ may also represent the angle between axes 115, 225 when mud motor 35 is in an undeflected state.

In some embodiments, bend adjustment assembly 300 is configured to adjust the deflection angle θ, with drillstring 24 and BHA 30 in-situ disposed in wellbore 3, between a first predetermined deflection angle, a second predetermined deflection angle that is different from the first deflection angle, and a third predetermined deflection angle that is different from the first deflection angle and second deflection angle. In other words, bend adjustment assembly 300 is configured to adjust the degree of bend 301 without needing to pull drillstring 24 from wellbore 3 to adjust bend adjustment assembly 300 at the surface, thereby reducing the amount of time required to drill wellbore 3. It may be understood that at least one of the three deflection angles is equal to zero, and that at least one of the three deflection angles is greater than zero. In other embodiments, bend adjustment assembly 300 may only be configured to adjust the deflection angle θ between only two different predetermined deflection angles θ, while in still other embodiments bend adjustment assembly 300 may adjust the deflection angle θ between three or more distinct deflection angles θ. In this exemplary embodiment, the first deflection angle is equal to approximately 1.5°, the second deflection angle is equal to approximately 0°, and the third deflection angle is equal to approximately 2.1°; however, in other embodiments, each of the deflection angles may vary.

In this exemplary embodiment, bend adjustment assembly 300 generally includes a first or uphole adjustment housing 310, a second or downhole adjustment housing 320, actuator housing 340, a piston mandrel 350, a first or uphole adjustment mandrel 360, a second or downhole adjustment mandrel 370, and a locking piston 380. Uphole adjustment housing 310 and downhole adjustment housing 320 may also be referred to herein as uphole offset housing 310 and downhole offset housing 320.

Uphole adjustment housing 310 of bend adjustment assembly 300 is generally tubular and has a first or uphole end 310A, a second or lower end 310B opposite uphole end 310A, and a central bore or passage defined by a generally cylindrical inner surface 312 extending between ends 310A and 310B. In this exemplary embodiment, uphole adjustment housing 310 comprises a plurality of tubular members coupled at sealed threaded connections, however, in other embodiments, uphole adjustment housing 310 may comprise a single, integrally or monolithically formed tubular member. Additionally, the inner surface 312 of uphole adjustment housing 310 includes an engagement surface 314 extending from uphole end 310A and a threaded connector 316 extending from lower end 3106. An annular seal 318 is disposed radially between engagement surface 314 of uphole adjustment housing 310 and an outer surface of uphole adjustment mandrel to seal the annular interface formed therebetween.

The lower housing 320 of bend adjustment assembly 300 is generally tubular and has a first or upper end 320A, a second or lower end 320B opposite upper end 320A, and a generally cylindrical inner surface 322 extending between ends 320A and 320B. A generally cylindrical outer surface of lower housing 320 includes a threaded connector coupled to the threaded connector 316 of upper housing 310. In this exemplary embodiment, the inner surface 322 of lower housing 320 includes an offset engagement surface 323 extending from upper end 320A, and a threaded connector extending from lower end 320B. In this exemplary embodiment, offset engagement surface 323 defines an offset bore or passage 327 (shown in FIG. 7) that extends from upper end 320A of lower housing 320. Additionally, lower housing 320 includes a central bore or passage 329 (shown in FIG. 7) extending from lower end 320B, where central bore 329 has a central axis disposed at a non-zero angle relative to a central axis of offset bore 327. In other words, offset engagement surface 323 has a central or longitudinal axis that is offset or disposed at a non-zero angle relative to a central or longitudinal axis of lower housing 320. Thus, the offset or angle formed between central bore 329 and offset bore 327 of lower housing 320 facilitates the selective formation of bend 301 described previously.

In this exemplary embodiment, lower housing 320 of bend adjustment assembly 300 includes an arcuate lip or extension 328 (shown in FIG. 9) formed at upper end 320A. Particularly, extension 328 extends arcuately between a pair of axially extending shoulders 328S. In this exemplary embodiment, extension 328 extends less than 180° about the central axis of lower housing 320; however, in other embodiments, the arcuate length or extension of extension 328 may vary. Additionally, the upper end 320A of lower housing 320 comprises a plurality of circumferentially spaced protrusions or castellations 334. Castellations 334 are spaced substantially about the circumference of the upper end 320A of lower housing 320, and may be formed on the portion of the circumference of upper end 320A comprising extension 328 as well as the portion of the circumference of upper end 320A which is arcuately spaced from extension 328. As will be described further herein, castellations 334 of lower housing 320 are configured to lock lower housing 320 with lower adjustment mandrel 370 to selectably restrict rotation therebetween. Lower housing 320 additionally includes a plurality of circumferentially spaced and axial ports 330 that extend axially between upper end 320A and lower end 320B.

Referring still to FIGS. 5-12, actuator housing 340 of bend adjustment assembly 300 houses the actuator assembly 400 of bend adjustment assembly 300 and couples bend adjustment assembly 300 with bearing assembly 200. Actuator housing 340 is generally tubular and has a first or upper end 340A, a second or lower end 340B opposite upper end 340A, and a central bore or passage defined by a generally cylindrical inner surface 342 extending between ends 340A and 340B. In this exemplary embodiment, a generally cylindrical outer surface of actuator housing 340 includes a threaded connector at upper end 340A that is coupled with the threaded connector of lower housing 320. In this exemplary embodiment, the inner surface 342 of actuator housing 340 includes a threaded connector 344 (shown in FIG. 5) at lower end 340B, an annular shoulder 346 (shown in FIG. 8), and a radial port 347 (shown in FIGS. 5, 8) that extends radially between inner surface 342 and the outer surface of actuator housing 340. Threaded connector 344 of actuator housing 340 may couple with a corresponding threaded connector disposed on an outer surface of bearing housing 210 at the upper end 210A of bearing housing 210 to thereby couple bend adjustment assembly 300 with bearing assembly 200. In this exemplary embodiment, the inner surface 342 of actuator housing 340 additionally includes an annular seal 348 (shown in FIG. 8) located proximal shoulder 346 and a plurality of circumferentially spaced and axially extending slots or grooves 349 (shown in FIG. 10).

Piston mandrel 350 (shown in FIG. 7) of bend adjustment assembly 300 is generally tubular and has a first or upper end 350A, a second or lower end 350B opposite upper end 350A, and a central bore or passage extending between ends 350A and 350B. Additionally, piston mandrel 350 includes a generally cylindrical outer surface comprising a threaded connector 351 and an annular seal 352. In other embodiments, piston mandrel 350 may not include connector 351. Threaded connector 351 extends from lower end 350B while annular seal 352 is located at upper end 350A that sealingly engages the inner surface of driveshaft housing 110. Further, piston mandrel 350 includes an annular shoulder 353 located proximal upper end 350A that physically engages or contacts an annular biasing member 354 extending about the outer surface of piston mandrel 350. In this exemplary embodiment, an annular compensating piston 356 is slidably disposed about the outer surface of piston mandrel 350. Compensating piston 356 includes a first or outer annular seal 358A disposed in an outer cylindrical surface of piston 356, and a second or inner annular seal 358B disposed in an inner cylindrical surface of piston 356, where inner seal 358B sealingly engages the outer surface of piston mandrel 350.

Upper adjustment mandrel 360 of bend adjustment assembly 300 is generally tubular and has a first or upper end 360A, and a second or lower end 360B opposite upper end 360A. In this exemplary embodiment, an annular seal 362 configured to sealingly engage the outer surface of piston mandrel 350 is positioned on an inner surface of upper adjustment mandrel 360. In this exemplary embodiment, the inner surface of upper adjustment mandrel 360 additionally includes a threaded connector 363 coupled with a threaded connector on the outer surface of piston mandrel 350 at the lower end 350B thereof. In other embodiments, upper adjustment mandrel 360 may not include connector 363.

Outer seal 358A of compensating piston 356 sealingly engages the inner surface of upper adjustment mandrel 360, restricting fluid communication between locking chamber 395 and a generally annular compensating chamber 359 formed about piston mandrel 350 and extending axially between seal 352 of piston mandrel 350 and outer seal 358A of compensating piston 356. In this configuration, compensating chamber 359 is in fluid communication with the surrounding environment (for example, the wellbore) via ports (hidden in FIG. 7) formed in driveshaft housing 110.

In this exemplary embodiment, upper adjustment mandrel 360 includes a generally cylindrical outer surface comprising a first or upper threaded connector 364, an offset engagement surface 365, and an outer sleeve 366 that forms an annular shoulder 368. Outer sleeve 366 is axially and rotationally locked to upper adjustment mandrel 360. Additionally, outer sleeve 366 is rotationally locked with lower adjustment mandrel 370 such that relative rotation between upper adjustment mandrel 360 and lower adjustment mandrel 370 is restricted. However, a limited degree of relative axial movement is permitted between outer sleeve 366 and lower adjustment mandrel 370, as will be described further herein. Upper threaded connector 364 of upper adjustment mandrel 360 extends from upper end 360A and may couple to a threaded connector disposed on the inner surface of driveshaft housing 110 at lower end 1106. Offset engagement surface 365 has a central or longitudinal axis that is offset from or disposed at a non-zero angle relative to a central or longitudinal axis of upper adjustment mandrel 360. Offset engagement surface 365 matingly engages the engagement surface 314 of upper housing 310, as will be described further herein. In this exemplary embodiment, the outer surface of upper offset mandrel 360 proximal lower end 360B includes an annular seal 367 that sealingly engages lower adjustment mandrel 370.

Lower adjustment mandrel 370 of bend adjustment assembly 300 is generally tubular and has a first or upper end 370A, and a second or lower end 370B opposite upper end 370A. In this exemplary embodiment, an inner surface of lower adjustment mandrel 370 includes one or more members (for example, pins, splines) in engagement with the outer sleeve 366 of upper adjustment mandrel 360 to restrict relative rotational movement while permitting relative axial movement therebetween. Additionally, lower adjustment mandrel 370 includes a generally cylindrical outer surface comprising an offset engagement surface 372, an annular seal 373, and an arcuately extending recess 374. Offset engagement surface 372 has a central or longitudinal axis that is offset or disposed at a non-zero angle relative to a central or longitudinal axis of the upper end 360A of upper adjustment mandrel 360 and the lower end 320B of lower housing 320, where offset engagement surface 372 is disposed directly adjacent or overlaps the offset engagement surface 323 of lower housing 320.

The annular seal 373 of lower adjustment mandrel 370 is disposed in the outer surface of lower adjustment mandrel 370 to sealingly engage the inner surface of lower housing 320. Arcuate recess 374 (shown in FIG. 11) of lower adjustment mandrel 370 is defined by an inner terminal end or arcuate shoulder 374E and a pair of circumferentially spaced axially extending shoulders 375. Lower adjustment mandrel 370 also includes a pair of circumferentially spaced first or short slots 376 and a pair of circumferentially spaced second or long slots 378, where both short slots 376 and long slots 378 extend axially into lower adjustment mandrel 370 from lower end 370B. In this exemplary embodiment, each short slot 376 is circumferentially spaced approximately 180° apart. Similarly, in this exemplary embodiment, each long slot 378 is circumferentially spaced approximately 180° apart; however, in other embodiments, the circumferential spacing of short slots 376 and long slots 378 may vary.

In this exemplary embodiment, the lower end 370B of lower adjustment mandrel 370 further includes a plurality of circumferentially spaced protrusions or castellations 377 configured to matingly or interlockingly engage the castellations 334 formed at the upper end 320A of lower housing 320. Castellations 377 are spaced substantially about the circumference of lower adjustment mandrel 370, and may be formed on the portion of the circumference of lower adjustment mandrel 370 comprising recess 374 as well as the portion of the circumference of lower adjustment mandrel 370 which is arcuately spaced from recess 374. In some embodiments, lower adjustment mandrel 370 comprises a first or downhole axial position (shown in FIG. 7) relative lower housing 320 and upper adjustment mandrel 360, and a second or uphole axial position relative lower housing 320 and upper adjustment mandrel 360 which is axially spaced from the downhole axial position. When lower adjustment mandrel 370 is in the downhole axial position, castellations 377 of lower adjustment mandrel 370 may interlock with castellations 334 of lower housing 320, restricting relative rotation therebetween. However, when lower adjustment mandrel 370 is in the uphole axial position, castellations 377 of lower adjustment mandrel 370 are axially spaced and disengaged from castellations 334 of lower housing 320, permitting relative rotation therebetween.

Referring still to FIGS. 5-12, locking piston 380 (shown in FIGS. 7, 12) of bend adjustment assembly 300 is generally tubular and has a first or upper end 380A, a second or lower end 380B opposite upper end 380A, and a central bore or passage extending therebetween. Locking piston 380 includes a generally cylindrical outer surface having an annular seal 382 positioned thereon. In this exemplary embodiment, locking piston 380 includes a pair of circumferentially spaced keys 384 that extend axially from upper end 380A, where each key 384 may extend through one of the circumferentially spaced slots 331 of lower housing 320. In this configuration, relative rotation between locking piston 380 and lower housing 320 is restricted while relative axial movement is permitted therebetween. As will be discussed further herein, each key 384 is receivable in either the pair of short slots 376 or pair of long slots 378 of lower adjustment mandrel 370 depending on the relative angular position between locking piston 380 and lower adjustment mandrel 370. Additionally, the outer surface of locking piston 380 may include an annular shoulder 386 located between ends 380A and 380B. As will be discussed further herein, a downhole directed biasing force is applied against the uphole end 380A of locking piston 380 by biasing member 354 while an uphole directed pressure force is applied to the downhole end 380B of locking piston 380 by the drilling fluid flowing through bend adjustment assembly 300.

In this exemplary embodiment, the sealing engagement between seals 382 of locking piston 380 and the inner surface 322 of lower housing 320 defines a lower axial end of locking chamber 395. In this configuration, locking chamber 395 extends longitudinally from the lower axial end thereof (defined by seals 382) to an upper axial end defined by the combination of sealing engagement between the outer seal 358A of compensating piston 356 and the inner seal 358B of piston 356. Particularly, lower adjustment mandrel 370 and upper adjustment mandrel 360 each include axially extending ports similar in configuration to the axial ports 330 of lower housing 320 such that fluid communication is provided between the annular space directly adjacent shoulder 386 of locking piston 380 and the annular space directly adjacent a lower end of compensating piston 356. For example, upper adjustment mandrel 360 includes one or more ports 369 (shown in FIG. 7) in fluid communication with axial ports 330. Locking chamber 395 is sealed from annulus 116 such that drilling fluid flowing into annulus 116 is not permitted to communicate with fluid disposed in locking chamber 395, where locking chamber 395 is filled with lubricant.

Figure 8:
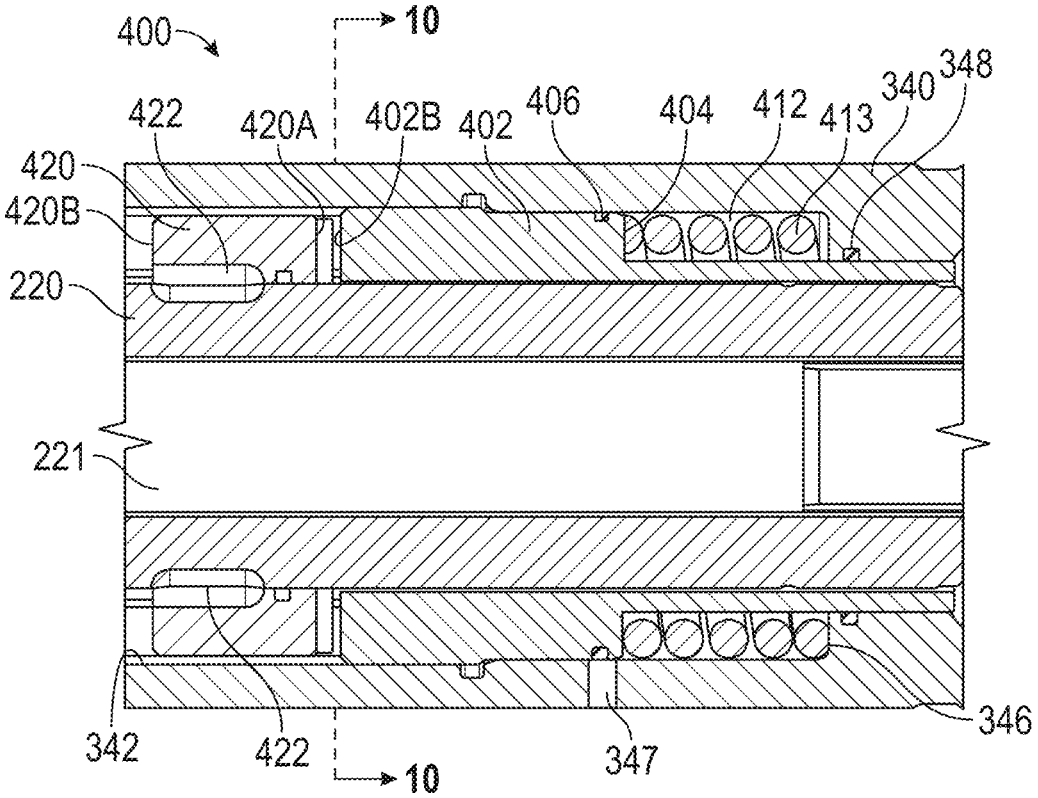
Figure 9:
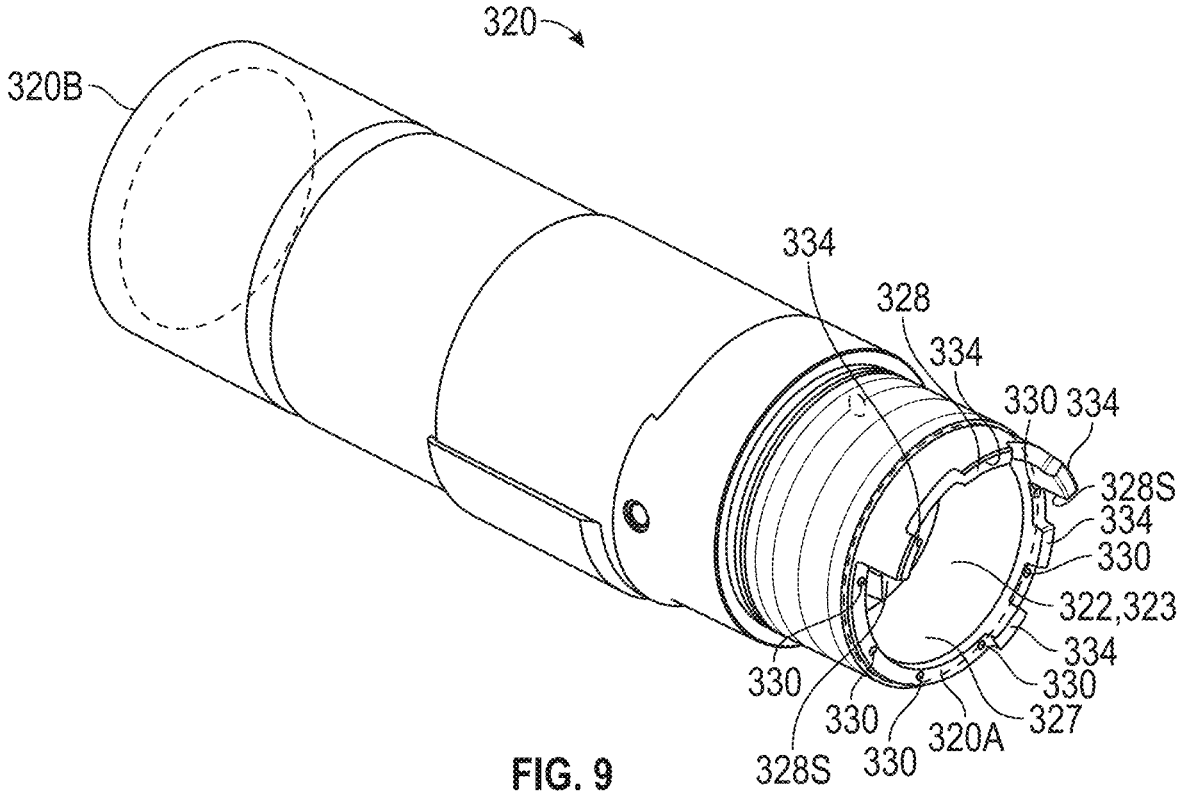
FIG. 9 is a perspective view of an embodiment of a lower housing of the mud motor of FIG. 1.
Figure 10:
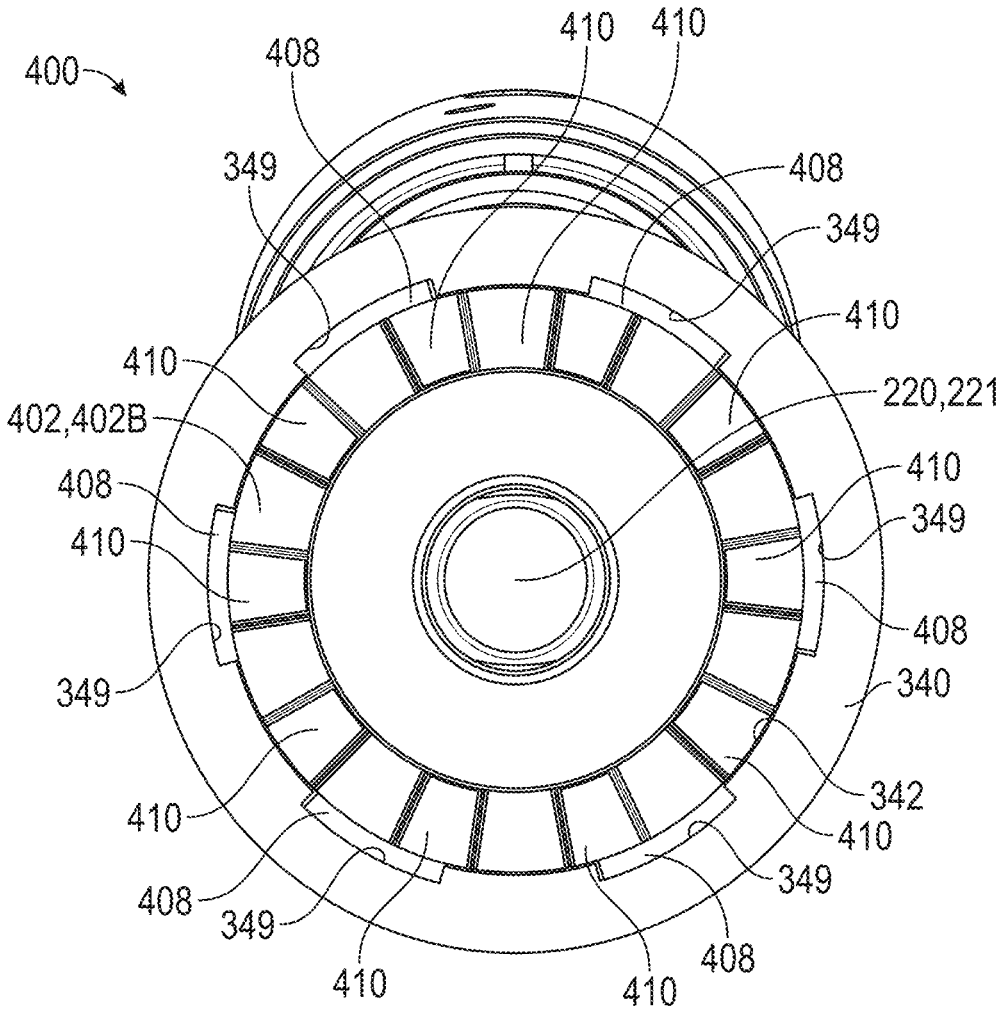
FIG. 10 is an end cross-sectional view of the mud motor of FIG. 1 along line 10-10 of FIG. 8.
Figure 11:
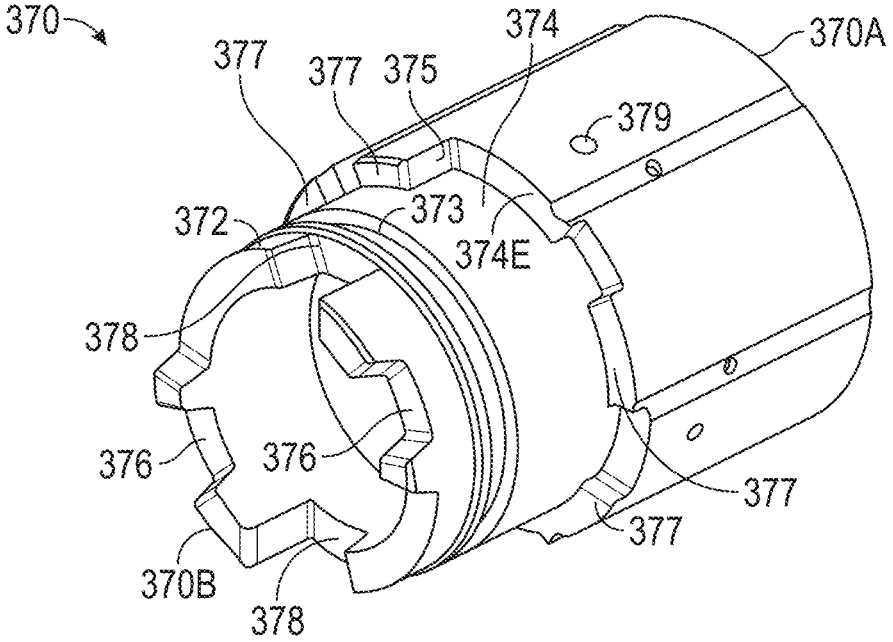
FIG. 11 is a perspective view of an embodiment of a lower adjustment mandrel of the mud motor of FIG. 1.
Figure 12:
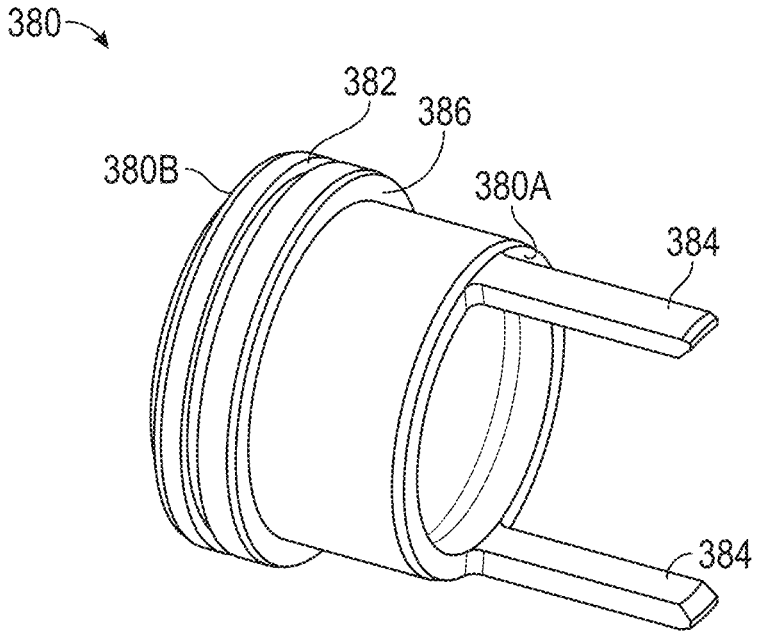
FIG. 12 is a perspective view of an embodiment of a locking piston of the mud motor of FIG. 1.
Figure 13:
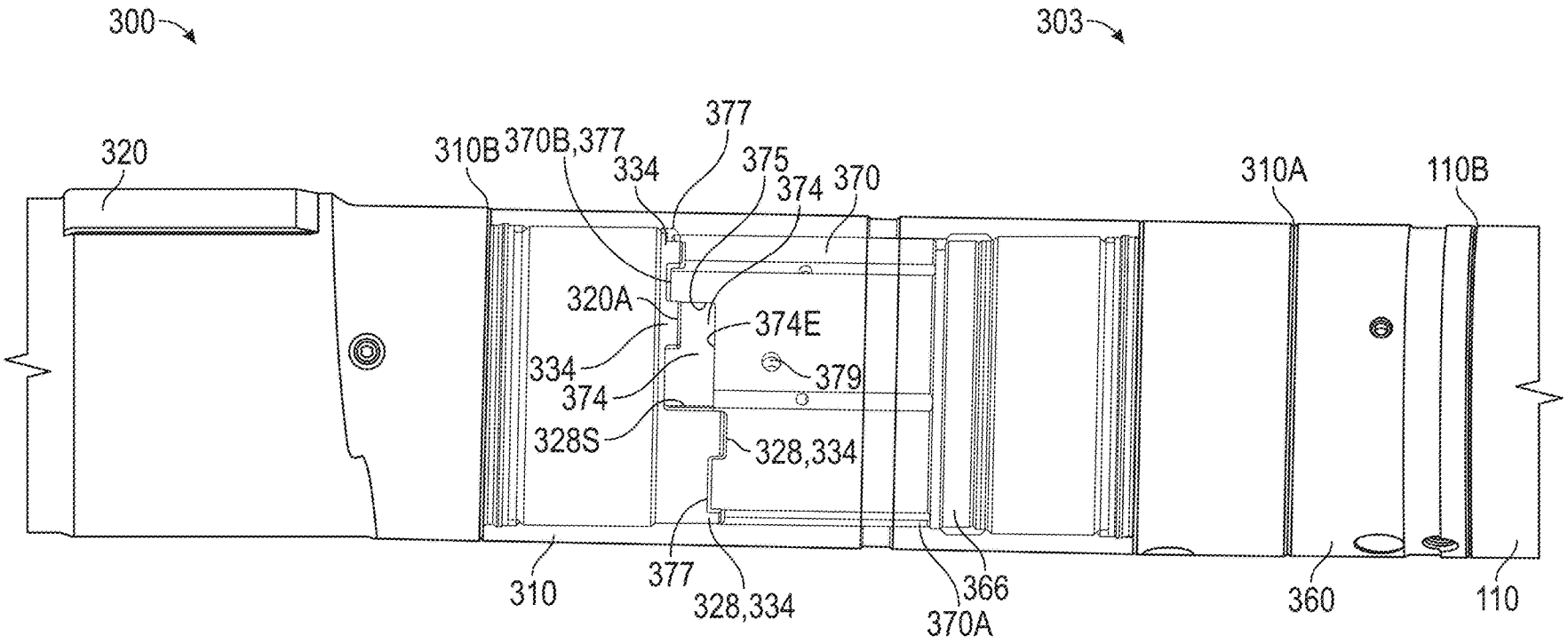
FIGS. 13 and 14 are zoomed-in side views of the mud motor of FIG. 1.

Referring now particularly to FIGS. 8 and 10, actuator assembly 400 of bend adjustment assembly 300 generally includes an actuator piston 402 and a torque transmitter or teeth ring 420. Actuator piston 402 is slidably disposed about bearing mandrel 220 and has a first or upper end 402A, a second or lower end 402B opposite upper end 402A, and a central bore or passage extending therebetween. In this exemplary embodiment, actuator piston 402 has a generally cylindrical outer surface including an annular shoulder 404 and an annular seal 406 positioned thereon and located axially between shoulder 404 and lower end 402B. In this exemplary embodiment, the outer surface of actuator piston 402 includes a plurality of radially outwards extending and circumferentially spaced keys 408 received in the slots 349 of actuator housing 340. In this arrangement, actuator piston 402 is permitted to slide axially relative actuator housing 340 while relative rotation between actuator housing 340 and actuator piston 402 is restricted, thereby allowing for the transfer of torque between piston 402 and actuator housing 340. Additionally, in this exemplary embodiment, actuator piston 402 includes a plurality of circumferentially spaced locking teeth 410 extending axially from lower end 4026.

The seal 406 of actuator piston 402 sealingly engages the inner surface 342 of actuator housing 340 and the seal 348 of actuator housing 340 sealingly engages the outer surface of actuator piston 402 to form an annular, sealed compensating chamber 412 extending axially therebetween. Fluid pressure within compensating chamber 412 is compensated or equalized with the surrounding environment (for example, wellbore 3) via radial port 347 of actuator housing 340. Additionally, an annular biasing member or element 413 is disposed within compensating chamber 412 and applies a biasing force against shoulder 404 of actuator piston 402 in the axial direction of teeth ring 420. Teeth ring 420 of actuator assembly 400 is generally tubular and comprises a first or upper end 420A, a second or lower end 420B opposite upper end 420A, and a central bore or passage extending between ends 420A and 420B. Teeth ring 420 is coupled to bearing mandrel 220 via a plurality of circumferentially spaced splines or pins 422 disposed radially therebetween. In this arrangement, relative axial and rotational movement between bearing mandrel 220 and teeth ring 420 is restricted and torque may be transferred between bearing mandrel 220 and teeth ring 420. In this exemplary embodiment, teeth ring 420 comprises a plurality of circumferentially spaced teeth 424 extending from upper end 420A. Teeth 424 of teeth ring 420 are configured to matingly engage or mesh with the teeth 410 of actuator piston 402 when biasing member 413 biases actuator piston 402 into contact with teeth ring 420, as will be discussed further herein.

In this exemplary embodiment, actuator assembly 400 is both mechanically and hydraulically biased during operation of mud motor 35. Additionally, the driveline of mud motor 35 is independent of the operation of actuator assembly 400 while drilling, thereby permitting transfer of substantially 100% of the available torque provided by power section 40 to power drill bit 32 when actuator assembly 400 is disengaged whereby teeth ring 420 is not engaged with piston 402. The disengagement of actuator assembly 400 may occur at high flowrates through mud motor 35, and thus, when higher hydraulic pressures are acting against actuator piston 402. In this configuration, actuator assembly 400 comprises a selective auxiliary drive that is simultaneously both mechanically and hydraulically biased. Further, this configuration of actuator assembly 400 allows for various levels of torque to be applied as the hydraulic effect can be used to effectively reduce the preload force of biasing member 413 acting on mating teeth ring 420. This type of angled tooth clutch may be governed by the angle of the teeth (for example, teeth 424 of teeth ring 420), the axial force applied to keep the teeth in contact, the friction of the teeth ramps, and the torque engaging the teeth to determine the slip torque that is required to have the teeth slide up and turn relative to each other.

In some embodiments, actuator assembly 400 permits rotation in mud motor 35 to rotate rotor 50 and bearing mandrel 220 until bend adjustment assembly 300 has fully actuated, and then, subsequently, ratchet or slip while transferring relatively large amounts of torque to bearing housing 210. This reaction torque may be adjusted by increasing the hydraulic force or hydraulic pressure acting on actuator piston 402, which may be accomplished by increasing flowrate through mud motor 35. When additional torque is needed a lower flowrate or fluid pressure can be applied to actuator assembly 400 to modulate the torque and thereby rotate bend adjustment assembly 300. The fluid pressure is transferred to actuator piston 402 by compensating piston 226. In some embodiments, the pressure drop across drill bit 32 may be used to increase the pressure acting on actuator piston 402 as flowrate through mud motor 35 is increased.

Figure 15:
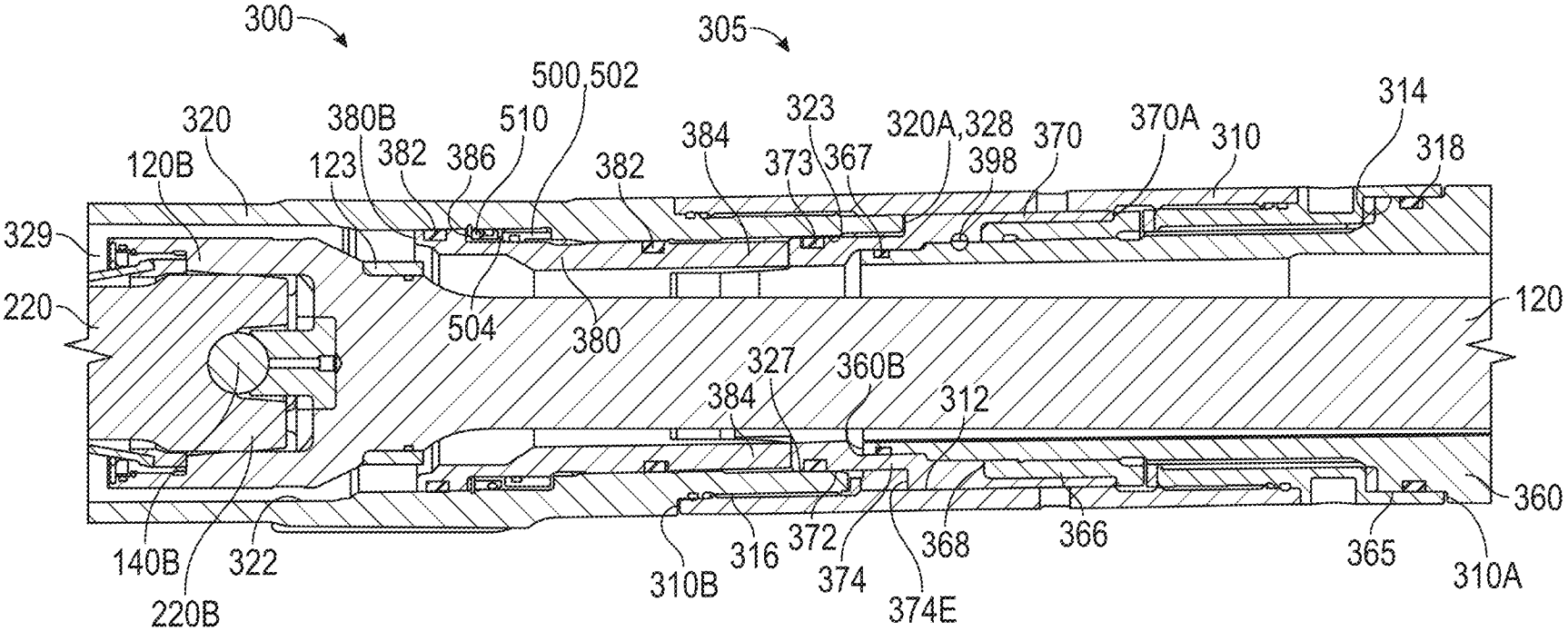
FIG. 15 is another zoomed-in, side cross-sectional view of the mud motor of FIG. 1.
Figure 16:
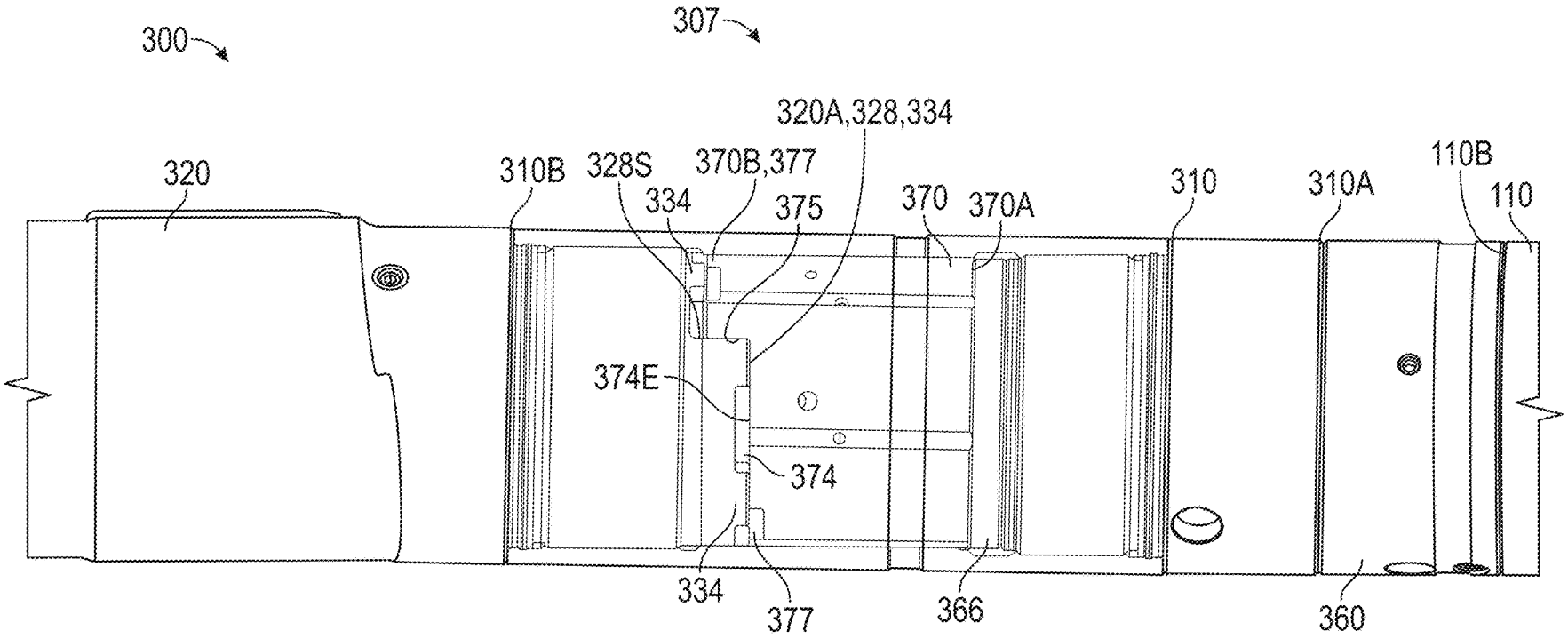
FIG. 16 is another zoomed-in side view of the mud motor of FIG. 1.
Figure 17:
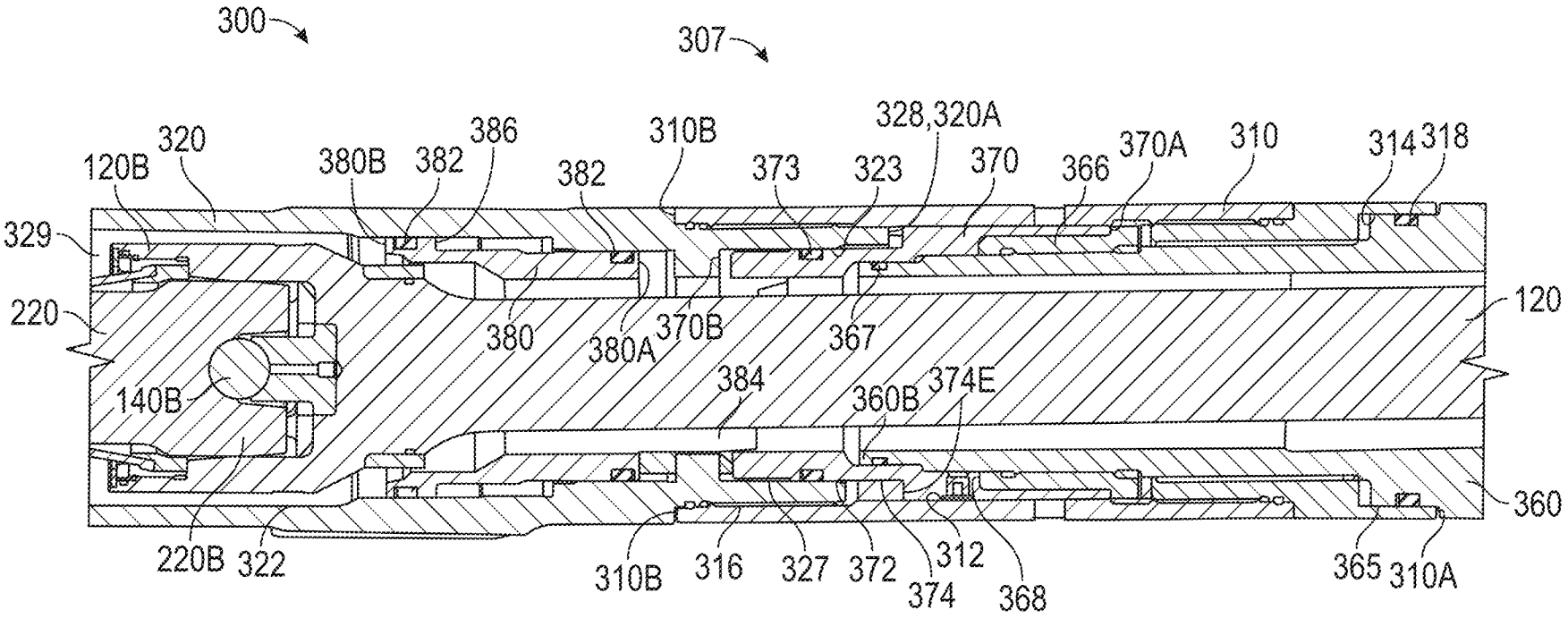
FIG. 17 is another zoomed-in, side cross-sectional view of the mud motor of FIG. 1.

Referring now to FIGS. 15-17, in some embodiments, bend adjustment assembly 300 includes a fluid metering assembly 500 (shown in FIG. 15 and hidden in FIG. 17) generally including an annular seal carrier 502 and an annular seal body 510, each disposed around the locking piston 380 of bend adjustment assembly 300. An outer surface of seal carrier 502 includes a plurality of flow channels extending between opposing ends thereof, and an inner surface of seal carrier 502 receives an annular seal configured to sealingly engage a detent or upset formed on the outer surface of locking piston 380. Seal body 510 has an outer surface that receives an annular seal configured to sealingly engage the inner surface 322 of lower housing 320. Seal body 510 also includes an inner surface which comprises a plurality of circumferentially spaced flow channels extending between opposing ends thereof. Additionally, an upper end of seal body 510 defines a seal endface 504 configured to sealingly engage a seal endface defined by a lower end of seal carrier 502. Further, endface 504 of seal body 510 includes a plurality of metering channels extending between the outer surface and the inner surface of seal body 510.

Fluid metering assembly 500 is generally configured to retard, delay, or limit the actuation of locking piston 380 between axially spaced unlocked and locked positions in at least one axial direction, as will be discussed further herein. via a change in flowrate or pressure across the downhole adjustable bend assembly 300. Particularly, in this exemplary embodiment, when locking piston 380 is actuated from a downhole or unlocked position to an uphole locked position, seal carrier 502 is axially spaced from seal body 510, permitting fluid within locking chamber 395 to flow freely between the endfaces of seal carrier 502 and seal body 510, respectively.

However, in this exemplary embodiment, when locking piston 380 is actuated from the locked position to the unlocked position, the endface of seal carrier 502 sealingly engages the endface 504 of seal body 510. In this configuration, fluid within locking chamber 395 may only travel between the endfaces of seal carrier 502 and seal body 510, respectively, via the metering channels of seal body 510, thereby restricting or metering fluid flow between seal carrier 502 and seal body 510. The flow restriction created between seal carrier 502 and seal body 510 in this configuration retards or delays the axial movement of locking piston 380 from the locked position to the unlocked position.

Figure 18:
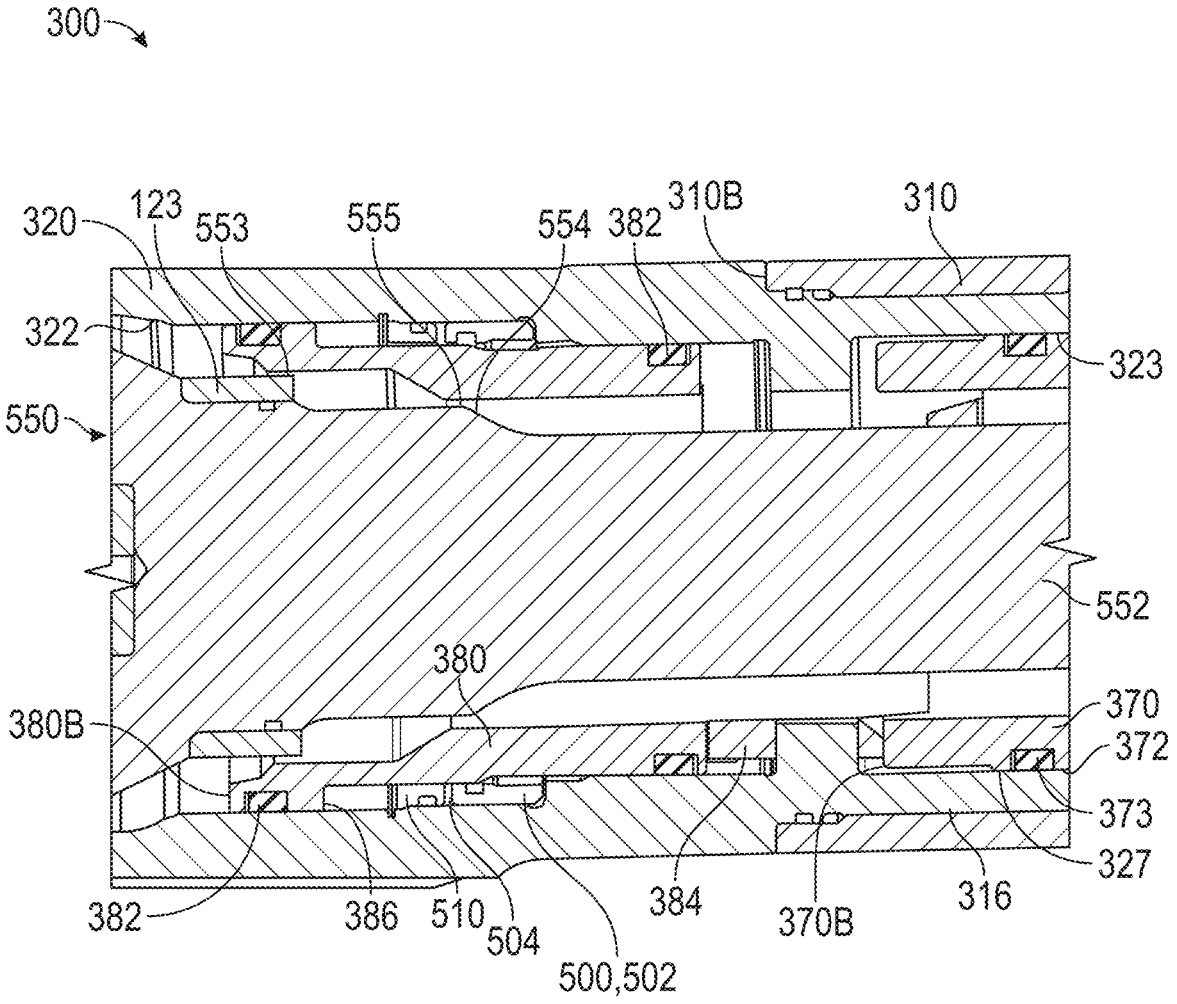
FIG. 18 is a zoomed-in, side cross-sectional view of another embodiment of a mud motor.

Referring to FIG. 18, another embodiment of a driveshaft assembly 550 of the mud motor 35 of FIG. 1 is shown. Driveshaft assembly 550 includes features in common with the driveshaft assembly 100 described previously, and shared features are labeled similarly. Particularly, driveshaft assembly 100 is similar to driveshaft assembly 100 described previously except that driveshaft assembly 550 includes a driveshaft 552 that includes an annular shoulder 554 which is axially spaced from flow restrictor 123, thereby creating two axially spaced "choke points" or variable flow restrictions 553 (formed between the inner surface of locking piston 380 and flow restrictor 123) and 555 (formed between the inner surface of locking piston 380 and shoulder 554 of driveshaft 552) for restricting the flow of drilling fluid through driveshaft assembly 550. Flow restrictor 123 and shoulder 554 may form a stepped flow restrictor. By including two separate choke points 553, 555 in series the pressure signal may be amplified at the surface by creating an overall larger flow restriction. Moreover, by utilizing two axially spaced choke points 553, 555 via flow restrictor 123 and shoulder 554 of driveshaft 552, a relatively large pressure drop and resulting pressure signal may be provided without needing to rely on a single choke point having a relatively small clearance that may clog with debris contained in the drilling fluid. In some embodiments, shoulder 554 and/or flow restrictor 123 may be provided with slots to enhance the ability of shoulder 554 and/or flow restrictor 123 to pass debris therethrough.

Referring to FIGS. 1 and 13-16, as previously described, drilling controller 90 (shown in FIG. 1) may adjust the deflection angle θ in response to a user input received by the drilling controller 90 through the I/O devices 93 of controller 90. For example, drilling system 10 may initially be operated in a straight-drilling mode whereby fluid is pumped through motor 35 and drillstring 24 is rotated at the surface by top drive 23, and rotation of drillstring 24 is transmitted to drill bit 32 to thereby drill into formation 5 and extend wellbore 3. At some point during the drilling of wellbore 3 it may be desired to switch from the straight-drilling mode of operation to a directional-drilling mode of operation for forming a deviated or curved portion of wellbore 3. To transition from the straight-drilling mode to the directional-drilling mode, rotation of drillstring 24 at the surface is reduced or ceased, and drill bit 32 is instead rotated by mud motor 35 in response to pumping drilling fluid from supply pump 13 to mud motor 35.

In some embodiments, initially, drilling system 10 may continue to drill wellbore 3 in the directional-drilling mode with the bend adjustment assembly 300 of motor 35 disposed in a first configuration 303 (shown in FIG. 13) providing a first deflection angle formed between the central axis 115 of driveshaft housing 110 and the central axis 37 of drill bit 32. Thus, a curved portion of wellbore 3 may be formed initially with drilling system 10 operating in the directional-drilling mode and bend adjustment assembly 300 disposed in the first configuration 303, where the radius of curvature of the curved portion of wellbore 3 being defined by a first deflection angle. The first configuration 303 may comprise an initial position of bend adjustment assembly 300.

As drill bit 32 forms the curved portion of the wellbore 3, it may be desirable to shift bend adjustment assembly 300 by the drilling controller 90 from the first configuration 303 to a second configuration 305 (shown in FIGS. 14, 15) to adjust or control the trajectory of the wellbore 3. For example, in this exemplary embodiment, it may be desired to drill a substantially straight, horizontal portion of wellbore 3 following the drilling of the curved portion of wellbore 3. In this example, the second configuration 305 of bend adjustment assembly 300 provides a second deflection angle that is less than the first deflection angle. For example, the second deflection angle may be equal to zero. Further, it may be desirable to alter the trajectory of wellbore 3 by forming a second curved portion following the substantially straight, horizontal portion of wellbore 3 drilled with bend adjustment assembly 300 in the second configuration 305. The drilling of the second curved portion of wellbore 3 may be accomplished by shifting the bend adjustment assembly 300 by the drilling controller 90 from the second configuration 305 to a third configuration 307 (shown in FIG. 16) in which the bend adjustment assembly 300 provides a third deflection angle that is different from the second deflection angle. In this example, the third deflection angle may be greater than the second deflection angle to permit the mud motor 35 to drill the second curved portion of wellbore 3 with bend adjustment assembly 300 in the third configuration 305.

Figure 19:
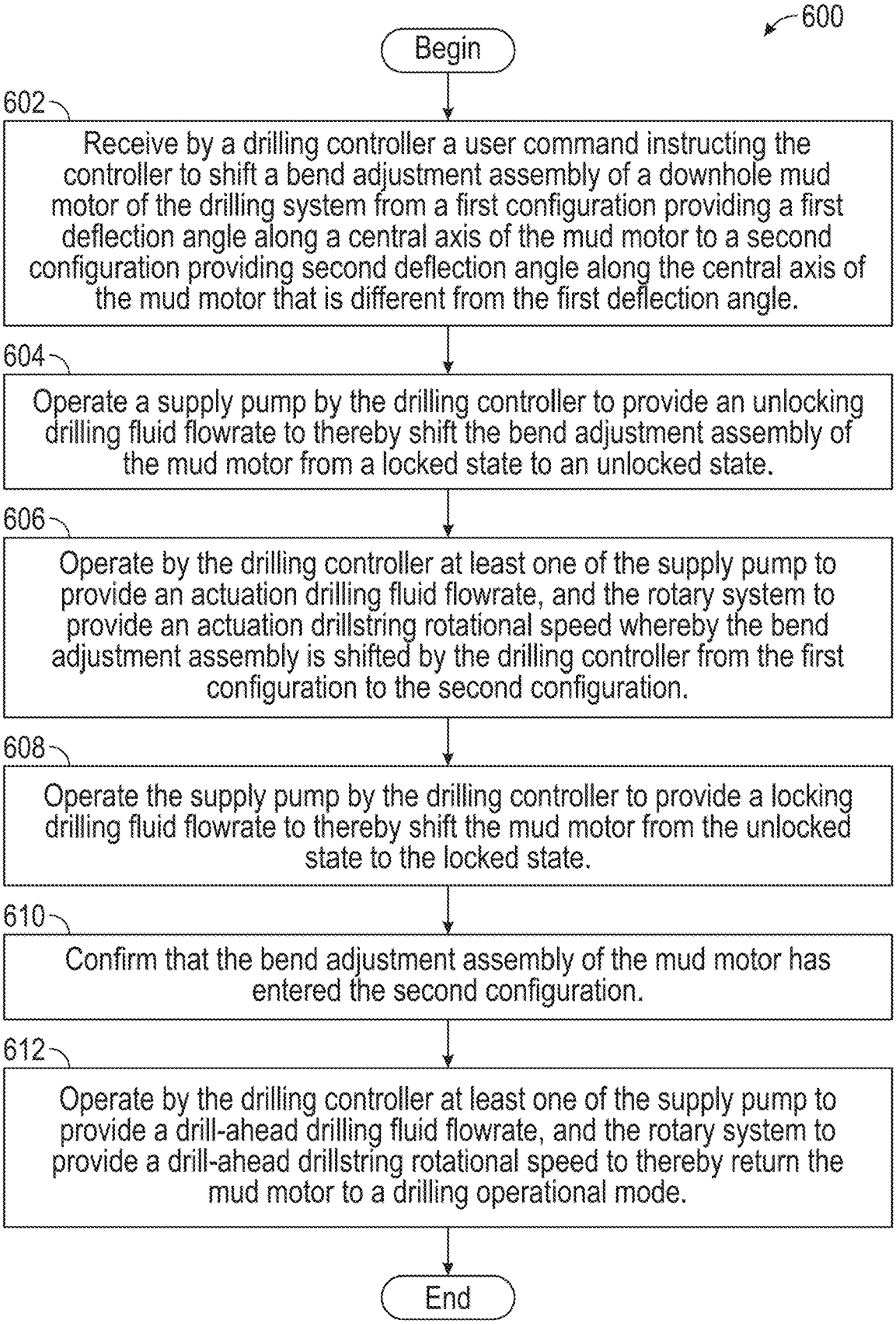
FIG. 19 is a flowchart of an embodiment of a method for controlling the operation of a downhole-adjustable mud motor using a drilling controller.
Figure 20:
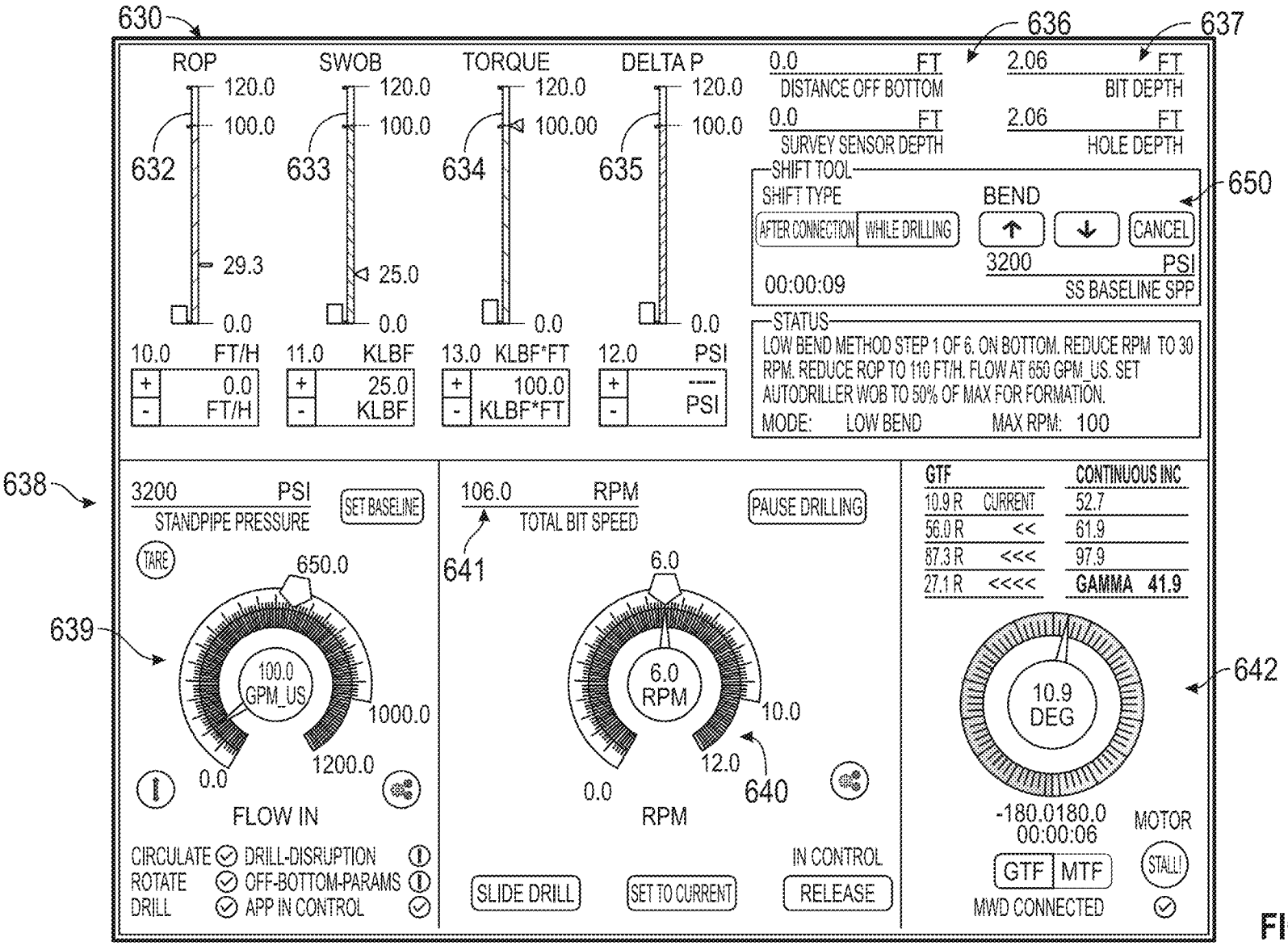
FIG. 20 is an exemplary screenshot from an embodiment of a drilling controller.

Referring now to FIGS. 1, 19, and 20, an embodiment of a method 600 (shown in FIG. 19) of controlling the operation of a downhole-adjustable mud motor using a drilling controller of a drilling system is shown. Beginning at block 602, method 600 includes receiving by a drilling controller a user command instructing the controller to shift a bend adjustment assembly of a downhole mud motor of the drilling system from a first configuration providing a first deflection angle along a central axis of the mud motor to a second configuration providing second deflection angle along the central axis of the mud motor that is different from the first deflection angle. In some embodiments, prior to block 602, method 600 may include providing the mud motor in a wellbore, the mud motor connected to a downhole end of a drillstring.

Figure 14:
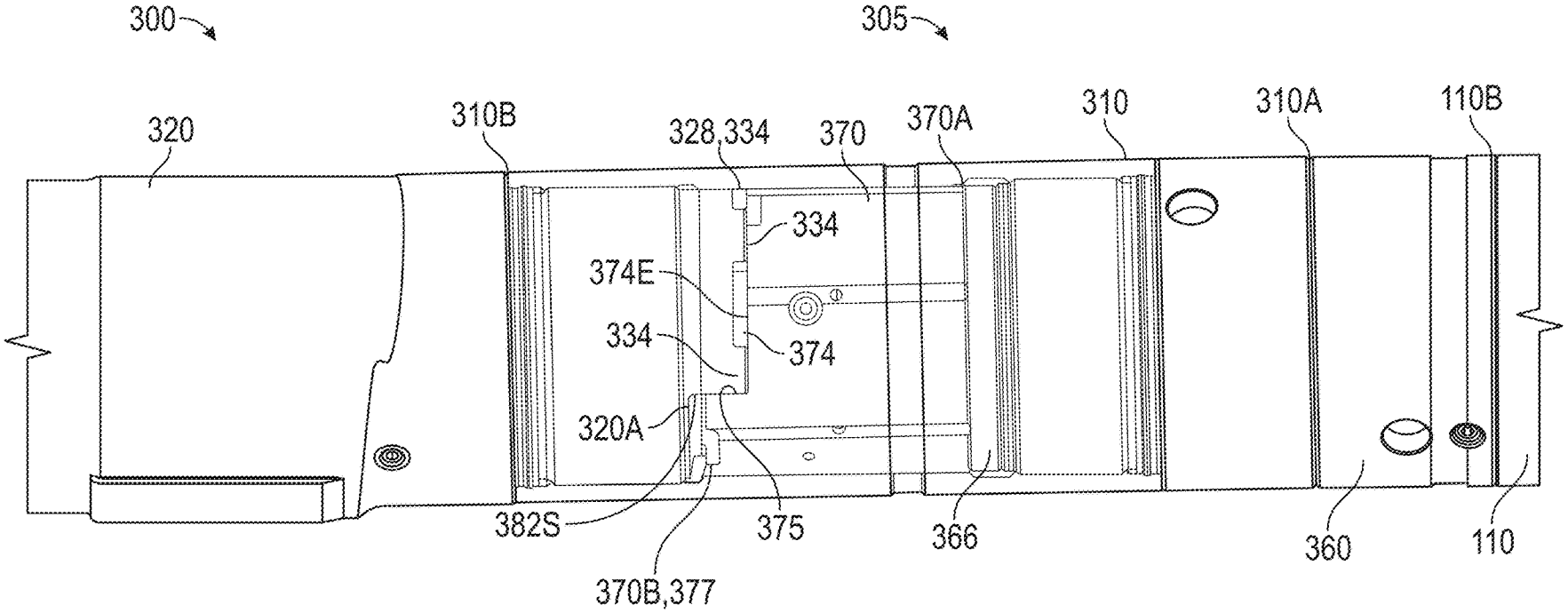

In some embodiments, the user may command the drilling controller 90 to shift the bend adjustment assembly 300 from the first configuration 303 (shown in FIG. 13) to the second configuration 305 (shown in FIGS. 14, 15). Alternatively, the user may command the drilling controller 90 to shift the bend adjustment assembly 300 from the second configuration 305 to the third configuration 307 (shown in FIG. 16). As a further alternative, the user may command the drilling controller 90 to shift the bend adjustment assembly 300 from the third configuration 307 to the second configuration 305.

In some embodiments, the user may enter the command through the I/O devices 93 of the drilling controller 90. Referring briefly to FIGS. 1, 20, an exemplary screenshot 630 providable by the I/O devices 93 of drilling controller 90 is shown. It may be understood that screenshot 630 is only exemplary and the way in which commands are inputted by the user to drilling controller 90 and the manner in which and the type of information indicated to the user by I/O devices 93 of drilling controller 90 may vary. In this exemplary embodiment, screenshot 630 indicates a variety of information to the user regarding the current status of various equipment of drilling system 10.

For example, screenshot 630 illustrates current rate of penetration (ROP) 632 of the drill bit 32 into the formation 5, a surface weight on bit (SWOB) 633 applied to the drill bit 32, a drillstring torque 634 applied to the drillstring 24, a differential pressure or AP 635 across a power section of a downhole mud motor which indicates a torque output of the mud motor, an off-bottom distance 636 of the drill bit 32, a surface depth 637 of the drill bit 32, an inlet or standpipe fluid pressure 638, an inlet flowrate 639 of drilling fluid 21 into the drillstring 24, a drillstring rotational speed 640 in rotations per minute (RPM) of the drillstring 24 at the surface 7, a bit rotational speed 641 in RPM of the drill bit 32. Additionally, screenshot 630 also includes current measurement while drilling MWD) information 642 of the drilling system 10. At least some of the information captured on screenshot 630 may be provided by sensors in signal communication with drilling controller 90. For example, pump sensor 95 may determine the current inlet flowrate 639, inlet pressure sensor 96 may determine the current standpipe fluid pressure 638, hookload sensor 97 may determine the current SWOB 633, and rotation sensor 98 may determine the current drillstring torque 634 and the current drillstring rotational speed 640. Additionally, block position sensor 99 may determine the current off-bottom distance 636 of drill bit 32 and a current ROP 632 of drill bit 32. It may be understood that screenshot 630 may capture information in addition to that shown in FIG. 20.

In addition to providing information of drilling system 10 to a user, screenshot 630 also provides an interface from which the user may input a command instructing the drilling controller 90 to shift motor 35 between the configurations 303, 305, and 307 thereof. Particularly, in this exemplary embodiment, screenshot 630 includes a shift input 650 from which the user may select the type of shift (for, from the second configuration 305 to the third configuration 307, from the third configuration 307 to the second configuration) . Additionally, the user may input via shift input 650 may select whether it is desired for the shift of the bend adjustment assembly 300 of motor 35 to occur as the motor 35 is engaged in drilling of the formation 5, or if it is preferred for the shift to occur after a drill stand (a plurality of pre-connected drill pipe joints) has been connected to the uphole end of the drillstring 24.

At block 604, method 600 includes operating a supply pump by the drilling controller to provide an unlocking drilling fluid flowrate to thereby shift the bend adjustment assembly of the mud motor from a locked state to an unlocked state. While in this exemplary embodiment block 604 precedes block 606, in some embodiments, it may be unnecessary to shift the mud motor from a locked state to an unlocked state prior to performing the step of block 606 as will be further described herein. For example, in some embodiments, the mud motor may only include an unlocked state and thus may not be shiftable between unlocked and locked states. Additionally, in some embodiments, block 604 may temporally overlap with block 606 such that a portion of the step performed at block 604 occurs concurrently with at least a portion of the step performed at block 606. Further, in some embodiments, at least a portion of the step performed at block 604 may occur after of at least a portion of the step performed at block 606.

In some embodiments, block 604 comprises altering by the drill controller 90 a flowrate of drilling fluid 21 delivered to motor 35 to provide the unlocking drilling fluid flowrate to thereby shift motor 35 from a locked state to an unlocked state. The unlocking drilling fluid flowrate may be stored as a value in the memory devices 92 of drilling controller 90. The drilling controller 90 may alter the flowrate of the drilling fluid 21 without human intervention by controlling the operation of supply pump 13.

In some embodiments, the drilling controller 90 shifts the motor 35 from the locked state to the unlocked state by shifting the locking piston 380 (shown in FIGS. 7, 15) of bend adjustment assembly 300 from a first or locked position restricting relative rotation between the offset housings 310, 320 (shown in FIGS. 7, 15) and the adjustment mandrels 360, 370, to a second or unlocked position axially spaced from the locked position that does not prevent relative rotation between the housings 310, 320 (shown in FIGS. 7, 15) and the adjustment mandrels 360, 370. The unlocked position of locking piston 380 may correspond to the unlocked state of bend adjustment assembly 300 while the locked position of locking piston 380 may correspond to the locked state of bend adjustment assembly 300.

In the locked position of locking piston 380 (shown in FIGS. 15, 17), keys 384 are received in either the pair of short slots 376 (shown in FIG. 17) or the pair of long slots 378 of lower adjustment mandrel 370 (shown in FIG. 15), thereby restricting relative rotation between locking piston 380, which is not permitted to rotate relative lower housing 320, and lower adjustment mandrel 370. In the unlocked position of locking piston 380, keys 384 of locking piston 380 are not received in either the pair of short slots 376 or the pair of long slots 378 of lower adjustment mandrel 370, and thus, rotation between lower housing 320 and lower adjustment mandrel 370 is not prevented by locking piston 380.

In some embodiments, drilling controller 90 may axially shift or displace the locking piston 380 from the locked position to the unlocked position by automatically reducing the flowrate of drilling fluid 21 until the unlocking drilling fluid flowrate is provided. For example, the drilling controller 90 may reduce the flowrate of drilling fluid 21 until it is equal to or less than the unlocking drilling fluid flowrate. In some embodiments, the unlocking drilling fluid flowrate may be equal to zero. Additionally, the drilling controller 90 may hold the flowrate of drilling fluid 21 at the reduced, unlocking flowrate for a predetermined time period sufficient to permit the locking piston 380 to travel from the locked position to the unlocked position. Particularly, at the reduced, unlocking flowrate of drilling fluid 21, the downhole directed biasing force applied by biasing member 354 against the uphole end 380A of locking piston 380 exceeds the uphole directed pressure force applied by drilling fluid 21 to the downhole end 380B of locking piston 380, thereby forcing locking piston 380 downhole from the locked position to the unlocked position.

At block 606, method 600 includes operating by the drilling controller at least one of the supply pump to provide an actuation drilling fluid flowrate, and the rotary system to provide an actuation drillstring rotational speed whereby the bend adjustment assembly is shifted by the drilling controller from the first configuration to the second configuration. In some embodiments, block 606 includes altering by the drill controller 90 at least one of a rotational speed of drillstring 24 connected to motor 35 and a flowrate of drilling fluid 21 delivered to motor 35 to provide an actuation drillstring rotational speed and an actuation drilling fluid flowrate stored in the memory devices 92 of the drilling controller 90 to thereby shift bend adjustment assembly 300 from a first configuration to a second configuration. For example, the drill controller 90 may adjust at least one of the rotational speed of drillstring 24 and the flowrate of drilling fluid 21 to shift bend adjustment assembly 300 from the first configuration 303 (shown in FIG. 13) to the second configuration 305 (shown in FIGS. 14, 15). In some embodiments, the actuation drilling fluid flowrate and the actuation drillstring rotation speed are stored as values in the memory devices 92 of drilling controller 90.

Alternatively, the drill controller 90 may adjust at least one of the rotational speed of drillstring 24 and the flowrate of drilling fluid 21 to shift bend adjustment assembly 300 from the second configuration 305 to the third configuration 307 (shown in FIG. 16). As a further alternative, the drill controller 90 may adjust at least one of the rotational speed of drillstring 24 and the flowrate of drilling fluid 21 to shift bend adjustment assembly 300 from the third configuration 307 to the second configuration 305. The drilling controller 90 may alter the rotational speed of drillstring 24 without human intervention by controlling the operation of top drive 23.

In some embodiments, drilling controller 90 shifts bend adjustment assembly 300 from the first configuration 303 to the second configuration 305 by increasing the flowrate of drilling fluid 21 supplied to motor 35 from a drilling flowrate until the flowrate equals or exceeds the actuation drilling fluid flowrate. For example, in an application where the drilling flowrate of drilling fluid supplied to mud motor 35 from supply pump 13 is approximately 500 gallons per minute (GPM), the actuation drilling fluid flowrate may be approximately 550-900 GPM or between approximately 10% and 80% greater than the drilling flowrate of drilling system 10; however, in other embodiments, the actuation flowrate for actuating bend adjustment assembly 300 from the first configuration 303 to the second configuration 305 may vary in the extent that the actuation flowrate exceeds the drilling flowrate, the actuation flowrate always being greater than the drilling flowrate so as to not hinder the operation of drilling system 10. For example, the actuation flowrate or pressure may be altered by increasing or decreasing the number of shear pins 379 and/or by altering the geometry (for example, increasing or decreasing the cross-sectional area) and/or materials comprising shear pin 379.

Once the actuation flowrate is provided, a net pressure force in the uphole direction is applied to lower adjustment mandrel 370 which is sufficient to shear or frangibly break shear pin 379 whereby the lower adjustment mandrel 370 is forced by the uphole directed pressure force from the downhole axial position (shown in FIG. 13) to the uphole axial position (shown in FIGS. 14, 15). Due to the sealing engagement of seal 373, the upper end 370A of lower adjustment mandrel 370 is exposed to pressure applied by biasing member 354 as well as the lubricant pressure contained in locking chamber 395 (maintained at wellbore pressure via pressure transmitted to locking chamber 395 from compensating chamber 359 through compensating piston 356) while lower end 370B is exposed to the pressure of drilling fluid flowing through bend adjustment assembly 300. Thus, an increase in flowrate of the drilling fluid supplied by supply pump 13 increases the uphole directed pressure force applied to the lower end 370B of lower adjustment mandrel 370. With lower adjustment mandrel 370 in the uphole axial position, castellations 377 of lower adjustment mandrel 370 are unlocked from castellations 334 of lower housing 320.

Following the displacement of lower adjustment mandrel 370 into the uphole axial position, drilling controller 90 may actuate bend adjustment assembly 300 from the first configuration 303 to the second configuration 305 by ceasing the pumping of drilling fluid from supply pump 13 for a predetermined period of time sufficient to complete the actuation of assembly 300 into the second configuration 305. Additionally, drilling controller concurrently activates top drive 23 to thereby increase the rotational speed of drillstring 24 until the actuation drillstring rotational speed is equaled or exceeded for a predetermined period of time.

Additionally, in some embodiments, drilling controller 90 concurrently activates top drive 23 to thereby increase the rotational speed of drillstring 24 until the actuation drillstring rotational speed is equaled or exceeded for a predetermined period of time. The rotational speed of drillstring 24 may be between approximately 1-70 revolutions per minute (RPM) of drillstring 24; however, in other embodiments, the rotational speed of drillstring 24 may vary. As drillstring 24 is rotated by drilling controller 90, reactive torque is applied to bearing housing 210 via physical engagement between stabilizers 211 (shown in FIG. 6) and the wall 19 of wellbore 3, thereby rotating bearing housing 210 and offset housings 310 and 320 (shown in FIG. 7), relative to the adjustment mandrels 360, 370 (shown in FIG. 7) in a first rotational direction. Rotation of lower housing 320 causes extension 328 (shown in FIG. 9) to rotate through recess 374 (shown in FIG. 11) of lower adjustment mandrel 370 until a shoulder 328S physically engages a corresponding shoulder 375 of recess 374, restricting further rotation of lower housing 320 in the first rotational direction. In some embodiments, this process may or may not be performed on bottom while drilling ahead.

Once the drilling controller 90 provides the actuation drillstring rotational speed in rotating drillstring 24, the drilling controller 90 concurrently operates supply pump 13 to pump drilling fluid 21 through drillstring 24 at the actuation drilling fluid flowrate. For example, the drilling controller 90 may concurrently operate the supply pump 13 and the top drive 23 such that the actuation flowrate and actuation rotational speed are provided concurrently for a predetermined period of time sufficient to shift the motor 35 into the second configuration 305. The concurrent operation of supply pump 13 and top drive 23 may minimize the time required for shifting the bend adjustment assembly 300 from the first configuration 303 to the second configuration 305 as compared to a manual shifting of assembly 300 between configurations 303 and 305 in which supply pump 13 and top drive 23 may not be controlled concurrently in an automated manner.

In some embodiments, in addition to automatically achieving the actuation drilling fluid flowrate and the actuation drillstring rotational speed, the drilling controller 90 may automatically adjust or monitor other parameters of drilling system 10 in addition to the drilling fluid flowrate and drillstring rotational speed, such as the position or speed of travelling block 20 which may be monitored and adjusted in order to adjust the current off-bottom 636 of drill bit 32 or to adjust the ROP 632 during shifting of the bend adjustment assembly 300. For example, drilling controller 90 may adjust the current ROP 632 of the drill bit 32 to provide an actuation ROP associated with the shifting of the bend adjustment assembly 300 from the first configuration to the second configuration. In this manner, the drilling controller 90 may displace BHA 30 through the wellbore 3 as the bend adjustment assembly 300 shifts between different configurations. Displacing the BHA 30 through the wellbore 3 may increase the amount of drag or reactive torque from the wall 19 of wellbore 3 acting against bearing housing 210

(e.g., the amount of drag acting against stabilizers 211 of housing 210) to assist in rotating bearing housing 210 and offset housings 310 and 320 more quickly and effectively during shifting of bend adjustment assembly 300.

Drilling controller 90 may also automatically manage the current SWOB 633 to maintain the current SWOB 633 within a desired range. Drilling controller 90 may also monitor the bit rotational speed 641 and current standpipe fluid pressure 638 to ensure each is maintained within desired limits when shifting the bend adjustment assembly 300 using the actuator assembly 400. For example, the drilling controller 90 may adjust the operation of supply pump 13 to maintain the current standpipe fluid pressure 638 within a desired range (e.g., 1% to 40% of the flowrate utilized during drilling) to provide the correct amount of torque to components of bend adjustment assembly 300 during shifting thereof.

Although block 606 is described previously in the context of shifting bend adjustment assembly 300 from the first configuration 303 (shown in FIG. 13) to the second configuration 305 (shown in FIGS. 14 and 15). In other embodiments, the manner in which the bend adjustment assembly shifts between separate configurations may vary from the manner in which bend adjustment assembly 300 is actuated between configurations 303 and 305. For example, in some embodiments, block 606 may comprise shifting bend adjustment assembly 300 from the second configuration 305 to the third configuration 307 (shown in FIG. 16), or from the third configuration 307 to the second configuration 305. It may be understood that the actuation drilling fluid flowrate and actuation drillstring rotational speed provided by drilling controller 90 may vary when shifting bend adjustment assembly 300 from the second configuration 305 to the third configuration 305 as compared with shifting assembly 300 from the first configuration 303 to the second configuration 305. Thus, a plurality of separate and distinct actuation drilling fluid flowrates and a plurality of separate and distinct drillstring rotational speeds may be stored as values in the memory devices 92 of drilling controller 90.

In an embodiment, rotational torque may be transmitted from bearing mandrel 220 to offset housings 310 and 320 in response to concurrently providing by the drilling controller 90 the actuation drilling fluid flowrate and the actuation drillstring rotational speed. In some embodiments, this actuation drilling fluid flowrate associated with shifting bend adjustment assembly 300 from the second configuration 305 to the third configuration 307 may be a reduced flowrate that is less than a drill-ahead drilling fluid flowrate and thus may also be referred to herein as a reduced drilling fluid flowrate. For example, the actuation drilling fluid flowrate may be approximately between 1% and 40% of the drill-ahead drilling fluid flowrate. As drilling fluid 21 is supplied at the reduced drilling fluid flowrate, rotational torque is transmitted to bearing mandrel 220 via rotor 50 of power section 40 and driveshaft 120 (shown in FIG. 7). It may be understood that the reduced flowrate is not sufficient to overcome the biasing force provided by biasing member 354 against locking piston 380 to thereby actuate locking piston 380 back into the locked position.

The reduced flowrate of drilling fluid 21 results in a reduction in an uphole directed pressure force applied to the lower end 402B (shown in FIG. 6) of piston 402 (relative to upper end 402A of piston 402 which receives wellbore pressure) of actuator assembly 400 whereby the biasing member 413 (shown in FIG. 6) of assembly 400 applies a biasing force against shoulder 404 of actuator piston 402 sufficient to urge actuator piston 402 into contact with teeth ring 420 (shown in FIG. 6) of assembly 400, with teeth 410 of piston 402 in meshing engagement with the teeth 424 of teeth ring 420.

In this arrangement, torque applied to bearing mandrel 220 is transmitted to actuator housing 340 (shown in FIG. 6) via the meshing engagement between teeth 424 of teeth ring 420 (rotationally fixed to bearing mandrel 220) and teeth 410 of actuator piston 402 (rotationally fixed to actuator housing 340). Rotational torque applied to actuator housing 340 via actuator assembly 400 is transmitted to offset housings 310 and 320 (shown in FIG. 7), which rotate (along with bearing housing 210) relative adjustment mandrels 360 and 370 (shown in FIG. 7). Particularly, extension 328 of lower housing 320 rotates through arcuate recess 374 (shown in FIGS. 16 and 17) of lower adjustment mandrel 370 until a shoulder 328S engages a corresponding shoulder 375 of recess 374, restricting further relative rotation between offset housings 310 and 320, and adjustment mandrels 360 and 370. Following the rotation of lower housing 320, bend adjustment assembly 300 is disposed in the third configuration 307 (shown in FIGS. 16 and 17) and thereby forms the third deflection angle associated with the third configuration 307 and which is different from the deflection angles associated with configurations 303 and 305.

In some embodiments, with bend adjustment assembly 300 in an unlocked state, drilling controller 90 may be utilized to shift bend adjustment assembly 300 between the second configuration 305 and the third configuration 307 an unlimited number of times in-situ. For example, the drilling controller 90 may return the bend adjustment assembly 300 to the second configuration 305 (shown in FIGS. 14 and 15) from the third configuration 307 (shown in FIGS. 16 and 17) by concurrently operating supply pump 13 to provide an actuation drilling fluid flowrate of zero (or close to zero) and top drive 23 to rotate the drillstring 24 from the surface 7. In this manner, offset housings 310 and 320 (shown in FIG. 7) are rotated by the drillstring 24 relative adjustment mandrels 360 and 370 (shown in FIG. 7) to return bend adjustment assembly 300 to the second configuration 305.

In some embodiments, drilling controller 90 may concurrently provide, along with the actuation drilling fluid flowrate and actuation drillstring rotational speed, an actuation SWOB (storable in memory devices 92 of drilling controller 90). For example, the drilling controller 90 may operate drawworks system 22 of drilling system 10 to provide the actuation SWOB to the drillstring 24 and mud motor 35 while drilling ahead with the drill bit 32 on-bottom. In some embodiments, a block position and block speed of the drawworks 22 may be monitored and adjusted in order to adjust the off-bottom position of the drill bit 32 or to adjust the ROP or speed of the drillstring 24 (up or down through wellbore 3) during shifting of the bend adjustment assembly 300. The actuation SWOB applied by top drive 23 to the motor 35 may assist in torqueing the drill bit 32 and thereby aid in shifting the bend adjustment assembly 300 from the third configuration 307 to the second configuration 305.

It may be understood that in other embodiments the procedures described previously for shifting bend adjustment assembly 300 by drilling controller 90 between configurations 303, 305, and 307 are only exemplary and may vary in other embodiments depending upon the particular configuration of bend adjustment assembly 300. As one example, the procedures for shifting bend adjustment assembly 300 between the second configuration 305 and third configuration 307 may be reversed by inverting or mirroring the features of lower adjustment mandrel 370 about the circumference thereof. As another example, lower adjustment mandrel 370 may be configured such that one of the second configuration 305 and third configuration 307 provides a deflection angle along mud motor 35 which is equal to the first deflection angle provided along mud motor 35 by the first configuration 303. In other embodiments, bend adjustment assembly 300 may only comprise two configurations (for example, first configuration 303 and second configuration 305) providing two separate deflection angles along mud motor 35 (for example, a low bend setting and a high bend setting) and may or may not include actuator assembly 400. As an example, a two-configuration bend adjustment assembly 300 may be shiftable from the first configuration 303 to the second configuration 305, but may become locked in the second configuration 305 once shifted into the second configuration 305. In this manner, the two-configuration bend adjustment assembly 300 may shift from a first fixed bend configuration to a second fixed bend configuration.

At block 608, method 600 includes operating the supply pump by the drilling controller to provide a locking drilling fluid flowrate to thereby shift the mud motor from the unlocked state to the locked state. While in this exemplary embodiment block 608 follows block 606, in some embodiments, it may be unnecessary to return the mud motor from the locked state to the unlocked state. While block 608 is shown in FIG. 19 as following block 606, it may be understood that block 608 may temporally overlap with block 606 such that a portion of the step performed at block 608 occurs concurrently with at least a portion of the step performed at block 606. Further, in some embodiments, at least a portion of the step performed at block 608 may occur before of at least a portion of the step performed at block 606.

In some embodiments, block 608 comprises altering by the drill controller 90 at least one of a rotational speed of drillstring 24 connected to motor 35 and a flowrate of drilling fluid 21 delivered to motor 35 to provide the locking drilling fluid flowrate to thereby shift motor 35 from a locked state to a locked state. The locking drilling fluid flowrate may be stored as a value in the memory devices 92 of drilling controller 90. In some embodiments, the drilling controller 90 shifts the motor 35 from the unlocked state to the locked state by shifting the locking piston 380 (shown in FIGS. 7, 15) of bend adjustment assembly 300 from the unlocked position permitting relative rotation between the offset housings 310, 320 (shown in FIGS. 7, 15) and the adjustment mandrels 360, 370, to the locked position preventing relative rotation between the housings 310, 320 and the adjustment mandrels 360, 370 whereby keys 384 are received in one of the pair of short slots 376 (shown in FIG. 17) and the pair of long slots 378 of lower adjustment mandrel 370 (shown in FIG. 15) depending upon the current configuration of bend adjustment assembly 300.

In some embodiments, drilling controller 90 axially shifts or displaces the locking piston 380 from the unlocked position to the locked position by automatically increasing the flowrate of drilling fluid 21 until the locking drilling fluid flowrate is provided. For example, the drilling controller 90 may increase the flowrate of drilling fluid 21 until it is equal to or greater than the locking drilling fluid flowrate. Additionally, the drilling controller 90 may hold the flowrate of drilling fluid 21 at the increased, locking flowrate for a predetermined time period sufficient to permit the locking piston 380 to travel from the unlocked position to the locked position. Particularly, at the increased, locking flowrate of drilling fluid 21, the uphole directed pressure force applied by drilling fluid 21 to the downhole end 380B of locking piston 380 exceeds the downhole directed biasing force applied by biasing member 354 against the uphole end 380A of locking piston 380, thereby forcing locking piston 380 uphole from the unlocked position to the locked position.

At block 610, method 600 comprises confirming that the bend adjustment assembly of the mud motor has entered the second configuration. In some embodiments, block 610 comprises confirming that the bend adjustment assembly 300 has entered the second configuration 305 (shown in FIGS. 14, 15). In other embodiments, block 610 comprises confirming the bend adjustment assembly 300 has entered the third configuration 307 (shown in FIG. 16). As an example, in some embodiments, a user may compare a baseline inlet or standpipe pressure with current standpipe fluid pressure 638 to confirm that the motor 35 has entered the second configuration 305. The user may input a confirmation command to the drilling controller 90 via I/O devices 93 should the difference between the baseline standpipe pressure and the current standpipe fluid pressure 638 correspond to an expected pressure differential seen in the current standpipe fluid pressure 638 at the drill-ahead drilling fluid flowrate. This pressure differential at a given flowrate is provided by the drilling controller 90 to the user to indicate to the user a successful shift of bend adjustment assembly 300.

Alternatively, the drilling controller 90 itself may automatically compare a baseline standpipe pressure with current standpipe fluid pressure 638 to confirm that motor 35 has entered the second configuration 305. The baseline standpipe pressure may be determined automatically by the drilling controller 90 when drilling system 10 is in a drilling operational mode before the drilling controller 90 is engaged by the user to shift the motor 35 between the first and second configurations. The baseline standpipe pressure may vary by depth, and thus the drilling controller 90 may periodically update the baseline standpipe pressure at regular temporal intervals or at predefined changes in depth (indicated to drilling controller 90 by MWD tools of the BHA 30) of the drill bit 32.

In this exemplary embodiment, the degree of restriction to the flow of drilling fluid 21 provided by the flow restrictor 123 (shown in FIG. 7) varies depending on the axial position of lower adjustment mandrel 370. Particularly, a flow restriction formed between the inner surface of locking piston 380 and flow restrictor 123 when lower adjustment mandrel 370 (shown in FIG. 7) is in the downhole axial position is reduced in response to the displacement of the lower adjustment mandrel 370 is from the downhole axial position to the uphole axial position. The reduced flow restriction may be registered at the surface 7 due to the reduced backpressure applied to the drilling fluid 21 flowing through standpipe 27 resulting from the reduction of the flow restriction provided by flow restrictor 123. While in this exemplary embodiment flow restrictor 123 registers the shifting of lower adjustment mandrel 370 into the uphole axial position, which is associated with the shifting of bend adjustment assembly 300 from the first configuration 303 to the second configuration 305; in other embodiments, flow restrictor 123 may alter a flow restriction through motor 35 registerable at the surface 7 as a backpressure seen as a change in the standpipe fluid pressure 638 in response to the actuation of motor 35 from the second configuration 305 to the third configuration 307, and from the third configuration 307 to the second configuration 305. The change in backpressure may inform the expected pressure differential between the baseline standpipe pressure and the current standpipe fluid pressure 638 which are compared by either the user or the drilling controller 90 to confirm the successful shifting of the motor 35. In some embodiments, drilling controller 90 indicates the expected pressure differential to the user. In this manner the drilling controller 90 may indicate to the user the successful shifting of motor 35 between each of the separate configurations 303, 305, and 307. It may be understood that the manner in which drilling controller 90 provides an indication to the user of whether or not bend adjustment assembly 300 has successfully shifted between two separate configurations may vary depending on the given embodiment.

In some embodiments, drilling controller 90 also concurrently determine the position or longitudinal speed of drill bit 32 relative to the bottom of wellbore 3 and control drawworks 22 to lift the 32 off the bottom or terminal end of the wellbore 3 for a predetermined period of time. For example, the drilling controller 90 may control the operation of the drawworks 22 to lift the drill bit 32 off of the bottom of the wellbore 3. The distance from the bottom of the wellbore 3 may be specified by the user in some embodiments using the I/O devices 93 and the specified off-bottom distance may vary depending upon the type of shift which will occur to the bend adjustment assembly 300. The motor 35 may be pulled off-bottom prior to take the torque load on motor 35 when on-bottom out of the equation when determining the current bend setting of bend adjustment assembly 300.

At block 612, method 600 includes operating by the drilling controller at least one of the supply pump to provide a drill-ahead drilling fluid flowrate, and the rotary system to provide a drill-ahead drillstring rotational speed to thereby return the mud motor to a drilling operational mode. In some embodiments, block 612 comprises altering by the drilling controller 90 (shown in FIG. 1) at least one of the rotational speed of drillstring 24 (shown in FIG. 1) to provide a drill-ahead drillstring rotational speed and a drill-ahead drilling fluid flowrate stored in the memory devices 92 of drilling controller 90. The drill-ahead drilling fluid flowrate and drill-ahead drillstring rotational speed may be stored in the memory devices 92 of drilling controller 90. In some embodiments, the drilling controller 90 operates supply pump 13 to increase the flowrate of drilling fluid 21 until the flowrate equals or exceeds the drill-ahead drilling fluid flowrate. In some embodiments, the drilling controller 90 concurrently operates the top drive 23 to increase the rotational speed of the drillstring 24 until the rotational speed of drillstring 24 equals or exceeds the drill-ahead drillstring rotational speed.

Figure 21:
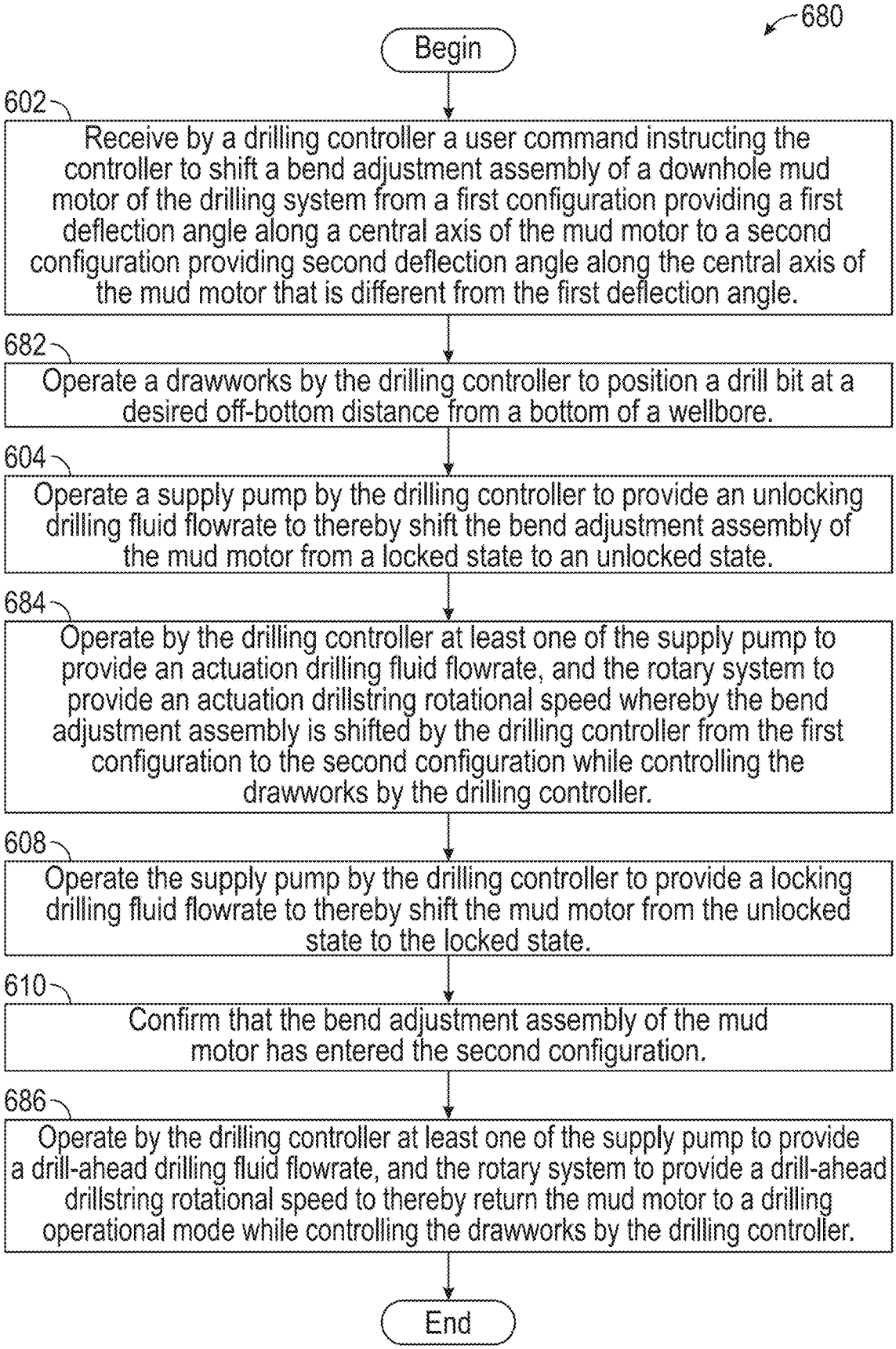
FIG. 21 is a flowchart of another embodiment of a method for controlling the operation of a downhole-adjustable mud motor using a drilling controller.
Figure 22:
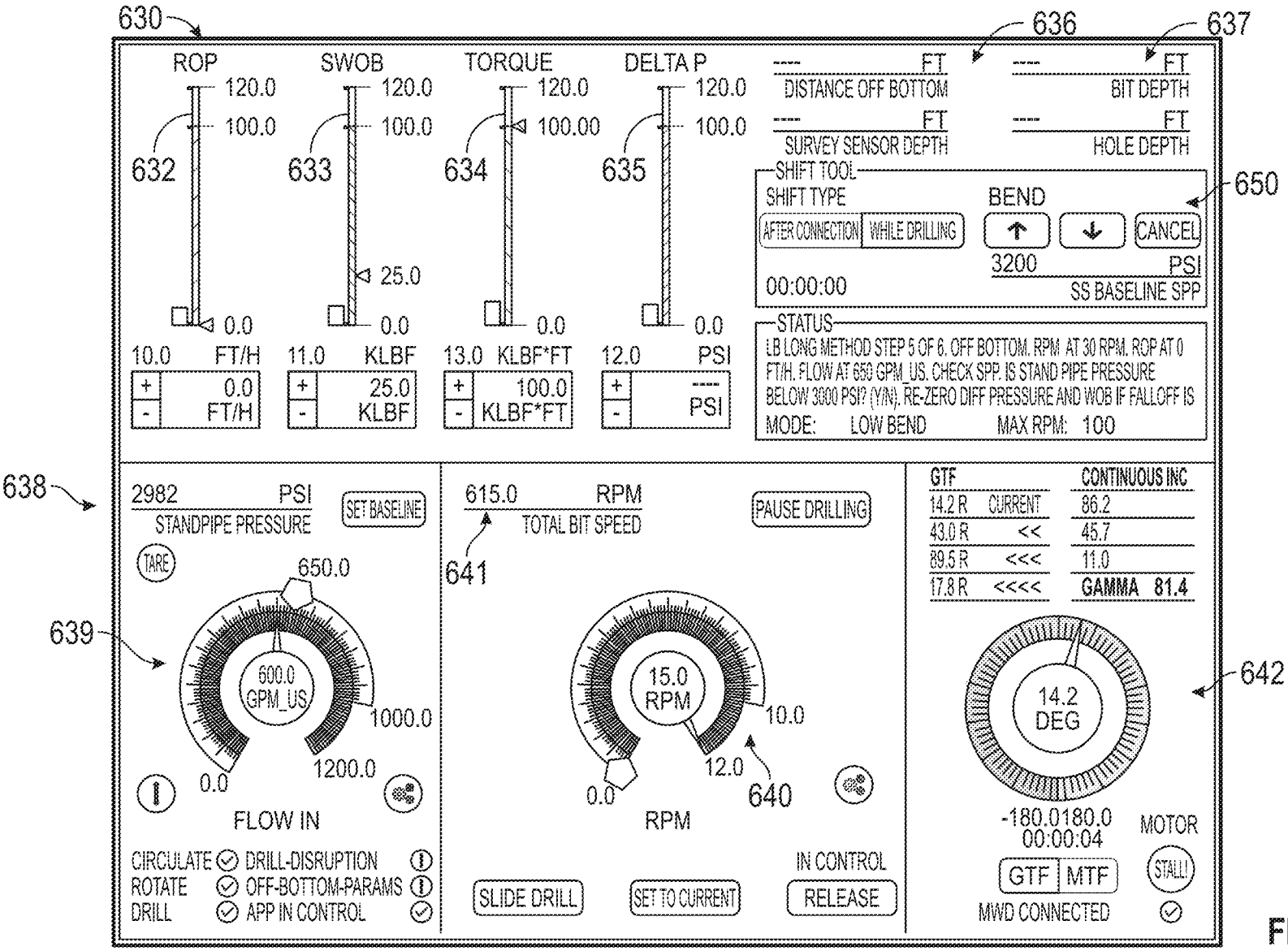
FIG. 22 is another exemplary screenshot from an embodiment of a drilling controller.

Referring now to FIGS. 1, 21, and 22, another embodiment of a method 680 (shown in FIG. 21) of controlling the operation of a downhole-adjustable mud motor using a drilling controller of a drilling system is shown. Method 680 includes features in common with the method 600 shown in FIG. 19, and shared features are labeled similarly. In this exemplary embodiment, method 680 is similar to method 600 except that method 680 adds a few additional method steps. Particularly, method 680 includes a block 682 (following block 602) in which a drawworks or other hoisting system is operated by the drilling controller to position a drill bit (connected to the downhole mud motor) at a desired off-bottom distance from a terminal end or bottom of a wellbore. In some embodiments, block 682 includes operating the drawworks 22 by the drilling controller 90 to lift the BHA 30 and drill bit 32 thereof from the bottom of wellbore 3 to a desired off-bottom distance from the bottom of wellbore 3. In some embodiments, the relative position between the drill bit 32 and the bottom of wellbore 3 is first determined by drilling controller 90 using the block position sensor 99 Additionally, the speed at which drill bit 32 is lifted off-bottom as well as the off-bottom distance of drill bit 32 may be monitored by drilling controller 90 using block position sensor 99. Block 682 may be followed by block 604 in this exemplary embodiment.

Block 684 is similar to the block 606 of method 600 except that block 684 additionally includes operating the hoisting system or drawworks (e.g., drawworks 22) by the drilling controller (e.g., drilling controller 90) (simultaneously with the operation of the at least one of the supply pump and the rotary system) to adjust a ROP of the bend adjustment assembly through the wellbore (or to apply a desired amount of SWOB) as part of a reaming or back-reaming operational mode. Thus, the drilling controller may simultaneously operate each of the supply pump, rotary system, and drawworks during the performance of block 684. However, the drilling controller 90 may first determine the relative position of the drill bit and the bottom of the wellbore and potentially adjust the off-bottom distance between the drill bit and the bottom of the wellbore prior to shifting the bend adjustment assembly in some embodiments. In this manner, the mud motor may be transported longitudinally through the wellbore thereby applying drag against the mud motor to aid in shifting the bend adjustment assembly via increased reactive torque applied to the bend adjustment assembly from the sidewall of the wellbore. Additionally, block 686 is similar to block 612 of method 600 except that block 686 also includes operating the drawworks by the drilling controller to adjust a ROP of the bend adjustment assembly through the wellbore (or to apply a desired amount of SWOB) when rotational speed is imparted to the drillstring at the surface via the rotary system. In some embodiments, block 686 includes controlling by the drilling controller (e.g., drilling controller 90) the hoisting system (e.g., drawworks 22) to control ROP of the mud motor once shifting of the bend adjustment assembly into the second configuration is completed.

Figure 23:
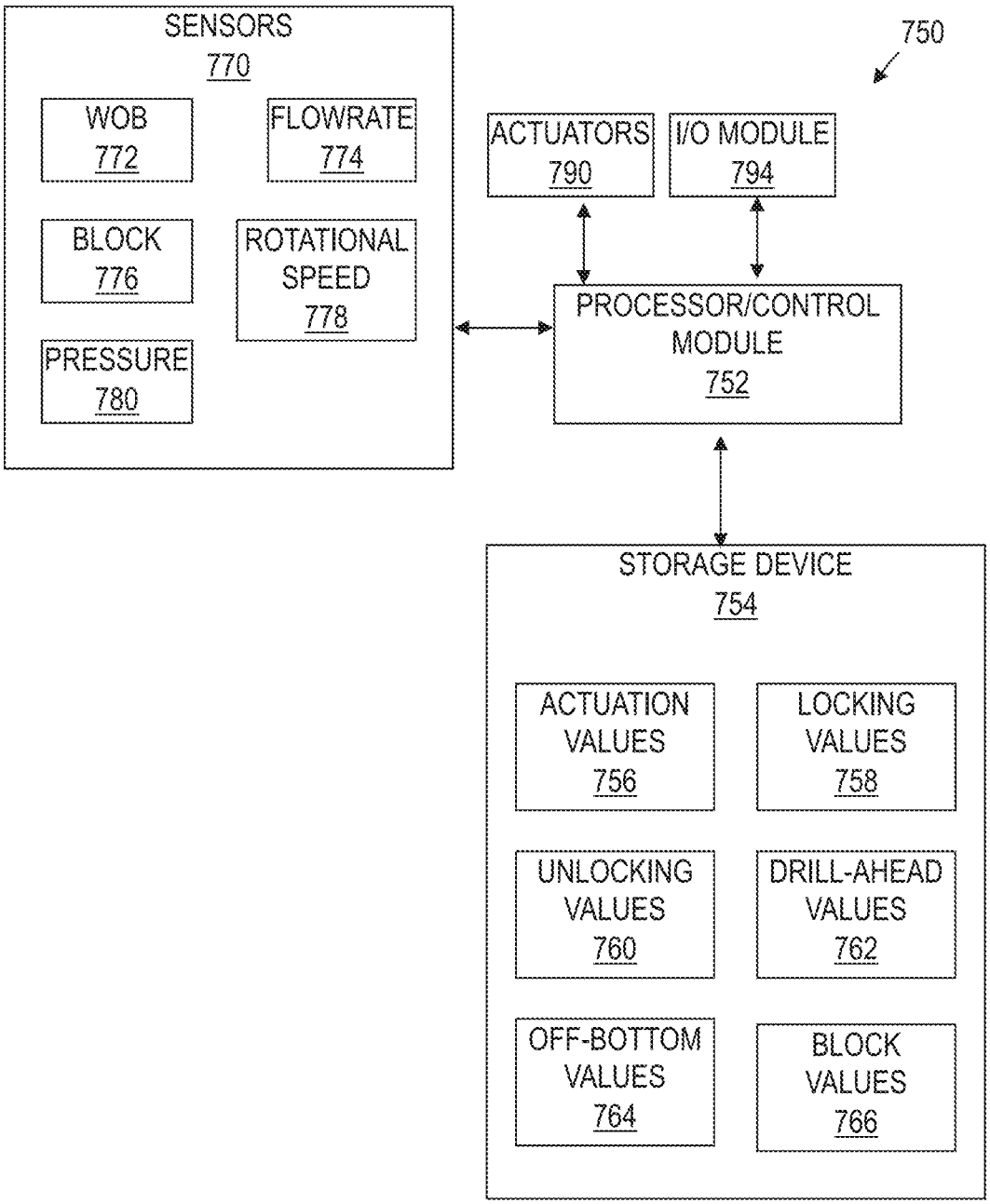
FIG. 23 is a block diagram of an embodiment of a drilling controller.

Referring to FIG. 23, a block diagram of another embodiment of the drilling controller 750 is shown. Drilling controller 750 may be utilized to perform at least some of the steps of method 600 shown in FIG. 19 and method 680 shown in FIG. 21. In this exemplary embodiment, drilling controller 750 generally includes a processor 752, and a storage or memory device 754. Processor 752 may also be referred to herein as drilling control module 752.

In some embodiments, drilling controller 750 also includes sensors 770, actuators 790, and a I/O module 794. However, it may be understood that in some embodiments sensors 770, actuators 790, and I/O module 794 may comprise components of a drilling system that is separate from the drilling controller 750. As an example, drilling controller 750 may comprise information encoded as software executable by a computer system (for example, a desktop computer, notebook computer, a tablet computer, a smartphone, a network server, or other suitable computing device known in the art) that may be connected to the sensors, actuators, and displays of a drilling system to permit the software-based drilling controller 750 to receive sensor data from the drilling system and to operate various components of the drilling system including, for example, a supply pump, a rotary system, and a drawworks of the drilling system. In some embodiments, the computer system embodying drilling controller 750 may comprise a plurality of separate computer systems, with one or more of the computer systems being located on drilling platform and/or locations remote from the drilling platform 102. For example, the computer system embodying drilling controller 750 may comprise one or more virtual servers in a cloud computing environment.

The processor 752 of drilling controller 750 is configured to execute instructions retrieved from storage device 754. The processor 752 may include any number of cores or sub-processors. Suitable processors include, for example, general-purpose processors, digital signal processors, and microcontrollers. Processor architectures generally include execution units (for example, fixed point, floating point, integer), storage (for example, registers, memory), instruction decoding, peripherals (for example, interrupt controllers, timers, direct memory access controllers), input/output systems (for example, serial ports, parallel ports) and various other components and sub-systems. Software programming, including instructions executable by the processor 752, is stored in the program/data storage device 754. In this exemplary embodiment, the program/data storage device 754 is a non-transitory computer-readable medium. Computer-readable storage media include volatile storage such as random-access memory, non-volatile storage (for example, ROM, PROM, a hard drive, an optical storage device (for example, CD or DVD), FLASH storage), or combinations thereof.

The memory/data storage device 754 of drilling controller 750 includes different drilling parameters stored as values in device 754. In this exemplary embodiment, storage device 754 stores actuation values for shifting a bend adjustment assembly (for example, bend adjustment assembly 300 shown in FIG. 1) between separate configurations, locking values 758 for shifting the bend adjustment assembly into a locked state, unlocking values 760 for shifting the bend adjustment assembly into an unlocked state, drilling or drill-ahead values 762 for shifting a mud motor (for example, mud motor 35 shown in FIG. 1) into a drilling or drill-ahead operational mode, off-bottom distance values 764 corresponding to different off-bottom distances for a drill bit (e.g., drill bit 32) depending on the type of shift to be provided along the mud motor, and block speed value 766 which may be associated with a reaming or backreaming operational mode of the drilling system. For example, the speed at which the travelling block (e.g., travelling block 20) travels during the reaming operational mode may be a set value corresponding to block speed value 766. The speed of the travelling block may be associated with a ROP of the BHA 30 and thus block speed value 766 may correspond or comprise a ROP value such as a drill-ahead ROP value provided when in a drill-ahead mode of operation. The different values 756, 758, 760, and 762 may correspond to different drilling parameters such as drilling fluid flowrates, drillstring rotational speeds, WOB, ROP, and other parameters like an off-bottom distance between a drill bit (for example, drill bit 32) and a terminal end or bottom of a wellbore.

As an example, locking values 758 may comprise a locking drilling fluid flowrate and a locking drillstring rotational speed. As another example, actuation values 756 may comprise an actuation drilling fluid flowrate, an actuation drillstring rotational speed, an actuation WOB, an actuation off-bottom distance, and an actuation ROP. Additionally, actuation values 756 may comprise multiple distinct sets of actuation values such as, for example, a first actuation, drillstring rotational speed and a first actuation drilling fluid flowrate, a second actuation drillstring rotational speed and a second actuation drilling fluid flowrate, and so on and so forth. The first actuation values may be configured to shift the bend adjustment assembly from a first configuration providing a first deflection angle into a second configuration providing a second deflection angle that is different from the first deflection angle, the second actuation values may be configured to shift the bend adjustment assembly from the second configuration into a third configuration providing a third deflection angle that is different from the first and second deflection angles, and so on and so forth.

The sensors 770 of drilling controller 750 are coupled to the processor 752, and, as discussed above, include sensors for measuring various drilling parameters. In this exemplary embodiment, sensors 770 include WOB sensors 772, flowrate sensors 774, travelling block sensors 776, rotational speed or RPM sensors 778, and drilling fluid pressure sensors 780. WOB sensors 772 (for example, strain gauges) attachable to a traveling block (for example, travelling block 20 shown in FIG. 1) or disposed in a BHA (for example, BHA 30 shown in FIG. 1) measure the portion of the weight of a drillstring (for example, drillstring 24 shown in FIG. 1) applied to a drill bit (for example, drill bit 32 shown in FIG. 1). For example, the WOB sensors 772 may monitor the current hookload to determine current WOB and thus may also be referred to herein as hookload sensors 772.

The drilling fluid flowrate sensors 774 may be coupled, for example, to an inlet fluid line or standpipe (for example standpipe 27 shown in FIG. 1) and measure a flowrate of the drilling fluid (for example, drilling fluid 21 shown in FIG. 1) supplied to a drillstring (for example, drillstring 24). travelling block sensors 776 may detect vertical position and vertical motion of a traveling block (for example, travelling block 20, an extension of the line supporting the traveling block, or other indications of a drillstring (for example, drillstring 24) descending into a wellbore.

Rotational speed sensors 778 (for example, angular position sensors) may be disposed, for example, in a BHA (for example, BHA 30), at a drill bit (for example, drill bit 32), or at the surface to detect a rotational speed of a drillstring (for example, drillstring 24) at the surface or the drill bit. Pressure sensors 780 may be connected along the inlet fluid line or standpipe (for example, standpipe 27) for detecting fluid pressure of a drilling (for example, drillstring 24) fluid that enters an uphole end of a drillstring. Pressure sensors 780 may also be connected to a BHA (for example, BHA 30) for measuring wellbore pressure. The current information measured by the sensors 770 may be communicated to processor 752 and displayed on a display I/O module 794 of drilling controller 750 so that the information may be communicated to a user of drilling controller 750.

In an exemplary embodiment, the actuators 790 of drilling controller 750 include mechanisms and/or interfaces of drilling system 10 (shown in FIG. 1) that are controlled by the processor 752 to affect drilling operations. For instance, actuators 790 are configured to control the drawworks 22 and thus the current ROP 632 (shown in FIG. 20), SWOB 633 (shown in FIG. 20), drillstring torque 634 (shown in FIG. 20), off-bottom distance 636 of the drill bit 32 (shown in FIG. 20), standpipe fluid pressure 638 (shown in FIG. 20), inlet flowrate 639 of drilling fluid 21 into the drillstring 24 (shown in FIG. 20), drillstring rotational speed 640 (shown in FIG. 20), and bit rotational speed 641 (shown in FIG. 20). As an example, processor 752 may control drillstring rotational speed 640 by controlling an electric motor through a motor controller of the top drive 23 (shown in FIG. 1), and may similarly control SWOB 633 by controlling top drive 23 or a motor in drawworks 22 (shown in FIG. 1). As another example, processor 752 may control the standpipe fluid pressure 638 by controlling a motor controller of the supply pump 13 (shown in FIG. 1). Various other types of actuators controlled by the processor 752 include solenoids, telemetry transmitters, valves.

Actuators 790 may control components of a drilling system (for example, drilling system 10) in order to execute or provide the values 756, 758, 760, or 762 stored in the storage device 754. As an example, actuators 790 may control the operation of a supply pump (for example, supply pump 13) and a rotary system (for example top drive 23) of the drilling system in order to provide an actuation drilling fluid flowrate and an actuation drillstring rotational speed of the actuation values 756 stored in storage device 754.

In this exemplary embodiment, I/O module 794 of drilling controller 750 includes one or more display devices used to convey information to a user of drilling controller 750. The I/O module 794 may be implemented using one or more display technologies known in that art, such as liquid crystal, cathode ray, plasma, organic light emitting diode, vacuum fluorescent, electroluminescent, electronic paper, or other display technology suitable for providing information to a user. The I/O module 794 also includes one or more input devices such as, for example, a keyboard into which the user of drilling controller 750 may input commands to the processor 752. For example, the user may input via the I/O module 794 an actuation command to shift a bend adjustment assembly (for example, bend adjustment assembly 300 shown in FIG. 1) between separate configurations providing separate deflection angles, and a confirmation command to confirm the shifting of the bend adjustment assembly into a desired configuration.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for drilling a wellbore in a subterranean earthen formation, comprising:

a drillstring;

a surface supply pump configured to pump a drilling fluid into an uphole end of the drillstring;

a surface rotary system coupled to the uphole end of the drillstring and configured to rotate the drillstring;

a drill bit coupled to a downhole end of the drillstring and configured to drill into the earthen formation in response to rotation of the drillstring;

a mud motor coupled to the downhole end of the drillstring, the mud motor comprising:

a driveshaft assembly comprising a driveshaft housing and a driveshaft rotatably disposed in the driveshaft housing;

a bearing assembly comprising a bearing housing and a bearing mandrel positioned in the bearing housing and coupled to the driveshaft; and a bend adjustment assembly shiftable between a first configuration that provides a first deflection angle between a longitudinal axis of the driveshaft housing and a longitudinal axis of the bearing mandrel, and a second configuration that provides a second deflection angle between the longitudinal axis of the driveshaft housing and the longitudinal axis of the bearing mandrel that is different from the first deflection angle;

a drilling controller comprising:

a storage device storing an actuation drilling fluid flowrate, and an actuation drillstring rotational speed; and a processor communicatively coupled to the storage device, wherein machine-readable instructions defining a drilling control module stored on the storage device, when executed on the processor, configure the processor to, in response to receiving an actuation command from a user, operate at least one of the supply pump to provide the actuation drilling fluid flowrate, and the rotary system to provide the actuation drillstring rotational speed to thereby shift the bend adjustment assembly from the first configuration to the second configuration.

2. The system of claim 1, wherein the machine-readable instructions, when executed by the processor, configure the processor to, in response to the actuation command, concurrently operate both the supply pump to provide the actuation drilling fluid flowrate and the rotary system to provide the actuation drillstring rotational speed.

3. The system of claim 1, wherein the system comprises a bottom hole assembly (BHA) comprising the mud motor and a second tool in addition to the mud motor, and wherein the drilling controller is configured to control the operation of the second tool.

4. The system of claim 1, wherein the machine-readable instructions, when executed by the processor, configure the processor to, in response to receiving the actuation command, concurrently operate each of the supply pump, the rotary system, and a hoisting system of the system to displace the mud motor through the wellbore.

5. The system of claim 1, wherein:

the bend adjustment assembly comprises an actuator assembly comprising an actuator housing, an actuator ring positioned in the actuator housing and coupled to the bearing mandrel, and an actuator piston positioned in the actuator housing and coupled to the actuator housing; and the actuator assembly is configured to transfer torque between the bearing mandrel and the actuator housing in response to the provision of at least one of the actuation drilling fluid flowrate and the actuation drillstring rotational speed.

6. The system of claim 1, wherein:

the bend adjustment assembly comprises an adjustment mandrel having a first axial position corresponding to the first configuration of the bend adjustment assembly and a second axial position that is axially spaced from the first axial position and which corresponds to the second configuration of the bend adjustment assembly; and the adjustment mandrel is configured to shift from the first axial position to the second axial position in response to the provision of the actuation drilling fluid flowrate.

7. The system of claim 1, wherein:

the bend adjustment assembly comprises an actuator assembly comprising an actuator housing, an actuator ring positioned in the actuator housing and coupled to the bearing mandrel, and an actuator piston positioned in the actuator housing and coupled to the actuator housing;

the bend adjustment assembly comprises an offset housing coupled to the driveshaft housing whereby relative rotation between the offset housing and the driveshaft housing is restricted, and an adjustment mandrel coupled to the bearing housing whereby relative rotation between the adjustment mandrel and the bearing housing is restricted; and the actuator assembly is configured to rotate the adjustment mandrel relative to the offset housing in response to at least one of the provision of the actuation drilling fluid flowrate and the provision of the actuation drillstring rotational speed whereby the bend adjustment assembly is shifted from the first configuration to the second configuration.

8. The system of claim 1, wherein:

the bend adjustment assembly comprises a locked state which prevents the bend adjustment assembly from shifting between the first configuration and the second configuration, and an unlocked state in which the bend adjustment assembly is permitted to shift between the first configuration and the second configuration;

the storage device stores an unlocking drilling fluid flowrate; and the machine-readable instructions, when executed by the processor, configure the processor to, in response to the actuation command, operate the supply pump to provide the unlocking drilling fluid flowrate to shift the bend adjustment assembly from the locked state to the unlocked state.

9. The system of claim 8, wherein the bend adjustment assembly comprises a locking piston having a first axial position corresponding to the unlocked state and a second axial position that is spaced from the first axial position and corresponds to the locked state.

10. The system of claim 9, wherein:

the storage device stores a drill-ahead drilling fluid flowrate and a drill-ahead drillstring rotation speed; and the machine-readable instructions, when executed by the processor, configure the processor to, in response to receiving a confirmation command from the user confirming the bend adjustment assembly is in the second configuration, operate the supply pump to provide the drill-ahead drilling fluid flowrate, and to operate the rotary system to provide the drill-ahead drillstring rotational speed.

11. The system of claim 10, wherein:

the storage device stores a drill-ahead rate of penetration (ROP); and the machine-readable instructions, when executed by the processor, configure the processor to, in response to receiving the confirmation command from the user confirming the bend adjustment assembly is in the second configuration, operate a hoisting system of the system to provide the mud motor with the drill-ahead ROP.

12. The system of claim 8, the storage device stores a locking drilling fluid flowrate; and the machine-readable instructions, when executed by the processor, configure the processor to, in response to receiving the actuation command, operate the supply pump to provide the locking drilling fluid flowrate to shift the bend adjustment assembly from the unlocked state to the locked state.

13. The system of claim 1, wherein the machine-readable instructions, when executed by the processor, configure the processor to, in response to receiving the actuation command, provide an indication to the user of whether the bend adjustment assembly has successfully shifted into the second configuration.

14. A drilling controller for controlling the operation of a drilling system having a downhole-adjustable mud motor, comprising:

a storage device storing an actuation drilling fluid flowrate providable by a surface supply pump of the drilling system, and an actuation drillstring rotational speed providable by a surface rotary system of the drilling system;

a processor communicatively coupled to the storage device, wherein machine-readable instructions defining a drilling control module stored on the storage device, when executed on the processor, configure the processor lo in response to receiving an actuation command from a user and when the processor is connected to at least one of the supply pump and the rotary system, operate at least one of the supply pump to provide the actuation drilling fluid flowrate and the rotary system to provide the actuation drilling fluid flowrate and the actuation drillstring rotational speed to shift a bend adjustment assembly of the mud motor from a first configuration providing a first deflection angle along the mud motor to a second configuration providing a second deflection angle along the mud motor that is different from the first deflection angle.

15. The drilling controller of claim 14, wherein the machine-readable instructions, when executed by the processor, configure the processor to, in response to the actuation command and when the drilling control module is connected to both the supply pump and the rotary system, concurrently operate both the supply pump to provide the actuation drilling fluid flowrate and the rotary system to provide the actuation drillstring rotational speed.

16. The drilling controller of claim 14, wherein the machine-readable instructions, when executed by the processor, configure the processor to, in response to the actuation command and when the drilling control module is connected to the supply pump, the rotary system, and a hoisting system, concurrently operate the supply pump to provide the actuation drilling fluid flowrate, the rotary system to provide the actuation drillstring rotational speed, and the hoisting system to provide either an actuation off-bottom distance between a drill bit connected to the mud motor and a bottom of a wellbore or an actuation rate of penetration (ROP) of the drill bit through the wellbore.

17. The drilling controller of claim 14, wherein the machine-readable instructions, when executed by the processor, configure the processor to, in response to the actuation command and when the processor is connected to the supply pump, operate the supply pump to provide a locking drilling fluid flowrate stored in the storage device to shift the bend adjustment assembly from an unlocked state to a locked state to prevent the bend adjustment assembly to shift between the first configuration and the second configuration.

18. The drilling controller of claim 17, wherein the machine-readable instructions, when executed by the processor, configure the processor to, in response to the actuation command and when the processor is connected to the supply pump, operate the supply pump to provide an unlocking drilling fluid flowrate stored in the storage device to shift the bend adjustment assembly from the locked state to the unlocked state to permit the bend adjustment assembly to shift between the first configuration and the second configuration.

19. The drilling controller of claim 14, wherein the machine-readable instructions, when executed by the processor, configure the processor to, in response to receiving the actuation command, provide an indication to the user of whether the bend adjustment assembly has successfully shifted into the second configuration.

20. The drilling controller of claim 19, wherein:

the storage device stores a drill-ahead drilling fluid flowrate and a drill-ahead drillstring rotation speed; and the machine-readable instructions, when executed by the processor, configure the processor to, when the processor is connected to both the supply pump and the rotary system and in response to receiving a confirmation command from the user confirming the bend adjustment assembly is in the second configuration, operate the supply pump to provide the drill-ahead drilling fluid flowrate, and to operate the rotary system to provide the drill-ahead drillstring rotational speed.

21. The drilling controller of claim 20, wherein:

the storage device stores a drill-ahead rate of penetration (ROP); and the machine-readable instructions, when executed by the processor, configure the processor to, when the processor is connected to the supply pump, the rotary system, and a hoisting system of the drilling system and in response to receiving a confirmation command from the user confirming the bend adjustment assembly is in the second configuration, operate the hoisting system to provide the mud motor with the drill-ahead ROP.

* * * * *